US009044651B2

(12) United States Patent
Campbell et al.

(10) Patent No.: US 9,044,651 B2
(45) **Date of Patent: *Jun. 2, 2015**

(54) DOUBLE STRAP CARRYING SYSTEM AND BASE STAND FOR GOLF BAGS AND OTHER SHOULDER-BORNE ARTICLES

(71) Applicant: NIKE, INC., Beaverton, OR (US)

(72) Inventors: Derek Campbell, Portland, OR (US); Christopher H. Pearson, Billings, MT (US)

(73) Assignee: NIKE, INC., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/455,402

(22) Filed: Aug. 8, 2014

(65) Prior Publication Data

US 2014/0346210 A1 Nov. 27, 2014

Related U.S. Application Data

(63) Continuation of application No. 13/453,415, filed on Apr. 23, 2012, now Pat. No. 8,833,622, which is a continuation of application No. 10/860,597, filed on Jun. 4, 2004, now Pat. No. 8,186,549.

(51) Int. Cl.

| | |
|---|---|
| ***A45F 3/14*** | (2006.01) |
| ***A63B 55/00*** | (2006.01) |
| *A45F 3/04* | (2006.01) |

(52) U.S. Cl.

CPC ..... *A63B 55/008* (2013.01); *A45F 3/04* (2013.01); *A63B 55/00* (2013.01); *A45F 3/14* (2013.01)

(58) Field of Classification Search

USPC ..... 224/259, 576, 578–580, 608, 627; 206/315.3, 315.7, 315.8

See application file for complete search history.

(56) References Cited

U.S. PATENT DOCUMENTS

| | | | |
|---|---|---|---|
| 1,444,157 | A | 2/1923 | Lee |
| 3,866,646 | A | 2/1975 | Nevard |

(Continued)

FOREIGN PATENT DOCUMENTS

| | | | |
|---|---|---|---|
| EP | 0 898 906 | A2 | 3/1999 |
| FR | 2 406 402 | A1 | 5/1979 |

(Continued)

OTHER PUBLICATIONS

Pre-Appeal Examination Report issued in Japanese Patent Application No. 2010-073971 dated Aug. 6, 2013.

(Continued)

*Primary Examiner* — Justin Larson

(74) *Attorney, Agent, or Firm* — Banner & Witcoff, Ltd.

(57) ABSTRACT

Dual-strap carrying assemblies and devices including such assemblies are provided herein. The carrying devices may be embodied in dual carrying strap golf bags that allow the bearer to more easily don and remove the bag. The secondary strap of the dual strap assembly is connected to the primary strap by a movable engagement assembly, such as an assembly that rotates to allow the secondary strap to more easily become within the reach of the bearer of the bag. In some embodiments, the movable engagement assembly may include a movement limiting device that prevents the secondary strap from moving too far out of the bearer's reach. The strap assemblies may be used in combination with a flexible base stand to make a self-standing carrying device that is easy to don and doff.

20 Claims, 22 Drawing Sheets

(56) References Cited

U.S. PATENT DOCUMENTS

| | | | | |
|---|---|---|---|---|
| D284,907 | S | 8/1986 | Wiedeman | |
| 4,834,235 | A | 5/1989 | Solheim et al. | |
| 4,999,931 | A | 3/1991 | Vermeulen | |
| 5,038,984 | A | 8/1991 | Izzo | |
| 5,294,183 | A | 3/1994 | Wetter et al. | |
| 5,319,836 | A | 6/1994 | Ida | |
| 5,361,957 | A | 11/1994 | Weintraub | |
| 5,435,647 | A | 7/1995 | Oliver | |
| 5,558,259 | A | 9/1996 | Izzo | |
| 5,566,871 | A | 10/1996 | Weintraub | |
| 5,593,077 | A | 1/1997 | Izzo | |
| 5,636,778 | A | 6/1997 | Jones et al. | |
| 5,829,719 | A | 11/1998 | Han | |
| 5,860,769 | A | 1/1999 | Seligman | |
| 5,947,282 | A | 9/1999 | Merrill et al. | |
| 5,954,255 | A | 9/1999 | Beebe et al. | |
| 5,988,475 | A | 11/1999 | Han | |
| 5,996,789 | A | 12/1999 | Suggs et al. | |
| 6,006,974 | A * | 12/1999 | Varney et al. | 224/645 |
| D422,791 | S | 4/2000 | Han | |
| 6,062,383 | A | 5/2000 | Han | |
| 6,098,797 | A | 8/2000 | Han | |
| 6,109,495 | A | 8/2000 | Hernandez | |
| 6,152,342 | A | 11/2000 | Suk | |
| 6,152,343 | A * | 11/2000 | Shin | 224/645 |
| 6,168,060 | B1 | 1/2001 | Mayers | |
| 6,223,959 | B1 | 5/2001 | Chen | |
| D448,170 | S | 9/2001 | Ammerman et al. | |
| 6,305,535 | B1 | 10/2001 | Fair | |
| 6,311,884 | B1 | 11/2001 | Johnson | |
| 6,315,117 | B1 | 11/2001 | Han | |
| 6,325,208 | B1 | 12/2001 | Cheng | |
| 6,386,362 | B1 | 5/2002 | Cheng | |
| 6,390,295 | B2 | 5/2002 | Rhee | |
| 6,412,734 | B2 | 7/2002 | Lin | |
| 6,450,334 | B1 | 9/2002 | Chang | |
| 6,457,620 | B1 * | 10/2002 | Batten et al. | 224/645 |
| 6,460,747 | B1 | 10/2002 | Tuerschmann et al. | |
| 6,471,105 | B1 | 10/2002 | Ammerman et al. | |
| 6,564,937 | B1 | 5/2003 | Cheng | |
| 6,568,527 | B1 | 5/2003 | Te-Pin | |
| 6,634,497 | B1 | 10/2003 | Chang | |
| 6,682,027 | B1 * | 1/2004 | Chang | 248/96 |
| 6,687,963 | B1 | 2/2004 | Chang | |
| 6,736,264 | B2 | 5/2004 | Yoshida | |
| 6,915,932 | B1 | 7/2005 | Wolfe | |
| 7,131,534 | B2 * | 11/2006 | Enes | 206/315.3 |
| 7,198,183 | B2 * | 4/2007 | Yang | 224/260 |
| 7,448,522 | B2 | 11/2008 | Collier et al. | |
| 8,186,549 | B2 * | 5/2012 | Campbell et al. | 224/576 |
| 8,322,585 | B2 * | 12/2012 | Herron et al. | 224/576 |
| 8,833,622 | B2 * | 9/2014 | Campbell et al. | 224/576 |
| 2002/0088836 | A1 | 7/2002 | Batten et al. | |
| 2003/0121942 | A1 * | 7/2003 | Chang | 224/260 |
| 2003/0168362 | A1 * | 9/2003 | Yoshida | 206/315.7 |
| 2004/0206793 | A2 | 10/2004 | Enes | |
| 2005/0092631 | A1 | 5/2005 | Campbell et al. | |

FOREIGN PATENT DOCUMENTS

| | | | |
|---|---|---|---|
| FR | 2 819 192 | A1 | 7/2002 |
| GB | 2 328 604 | A | 3/1999 |
| JP | 2-15175 | | 1/1990 |
| JP | 6-36660 | | 5/1994 |
| JP | 7-3319 | | 1/1995 |
| JP | 3042504 | U | 10/1997 |
| JP | H11-164723 | A | 6/1999 |
| JP | 2001-198250 | A | 7/2001 |
| JP | 2003-325713 | A | 11/2003 |
| WO | 98/17144 | A1 | 4/1998 |
| WO | 01/50909 | A1 | 7/2001 |

OTHER PUBLICATIONS

Notice of Reasons for Rejection issued in Japanese Patent Application No. 2013-040752 dated Sep. 11, 2013.

International Search Report issued in International Patent Application No. PCT/US2005/019487 dated Oct. 5, 2005.

Internet printout: http://teetogreendiscountgolf.com/Accessories/dualstrapbag.htm, IZZO Dual Strap Bag, dated May 19, 2004.

Internet printout: http://www.golfdiscount.com/Detail.bok?searchpath, Ladies' Superlight 3.5 Dual-Strap Stand Bag, dated May 19, 2004.

Notice of Reasons for Rejection issued in Japanese Patent Application No. 2010-073971 dated Mar. 17, 2011.

Notice of Reasons for Rejection issued in Japanese Patent Application No. 2010-073971 dated May 2, 2012.

Decision of Rejection issued in Japanese Patent Application No. 2010-073971 dated Nov. 1, 2012.

Questioning issued in Japanese Patent Application No. 2010-073971 dated Aug. 21, 2013.

* cited by examiner

OFF POSITION

ROTATION LIMIT

DOUBLE STRAP CARRYING SYSTEM AND BASE STAND FOR GOLF BAGS AND OTHER SHOULDER-BORNE ARTICLES

CROSS REFERENCE TO RELATED APPLICATION

This U.S. Patent Application is a continuation of and claims priority to U.S. patent application Ser. No. 13/453,415 which was filed Apr. 23, 2012 entitled "Double Strap Carrying System and Base Stand for Golf Bags and Other Shoulder-Borne Articles" (now U.S. Pat. No. 8,833,622 issued on Sep. 16, 2014), which application is a continuation of and claims priority to U.S. patent application Ser. No. 10/860,597 which was filed Jun. 4, 2004 in the U.S. Patent and Trademark Office and entitled "Double Strap Carrying System and Base Stand for Golf Bags and Other Shoulder-Borne Articles" (now U.S. Pat. No. 8,186,549 issued May 29, 2012) Additionally, this application is related to U.S. patent application Ser. No. 10/700,043, which was filed Nov. 4, 2003 in the U.S. Patent and Trademark Office entitled "Golf Bag Base." These prior U.S. Patent Applications are entirely incorporated herein by reference.

FIELD OF THE INVENTION

The invention relates generally to golf bags and other shoulder-borne articles, such as luggage, backpacks, duffle bags, equipment carrying cases, and other load-carrying devices. In some examples, the invention provides a shoulder-borne article with a movable coupling system between two shoulder straps of a carrying system that provides a range of motion to one of the straps with respect to the other strap to thereby allow the bearer to more easily locate, don and remove the strap. Additional aspects of the invention relate to features of the base stand and its combined use with the carrying system described above.

BACKGROUND OF THE INVENTION

The sport of golf stands as one of the most popular games in the world today. Technological innovations have been regularly improving almost every aspect of the game, including the equipment used to tote the golf clubs both on and away from the golf course. Golf carrying bags that were once made from heavy canvas and steel rods have been replaced by bags made from lighter, more durable composite metals and plastics.

Originally, golf carrying bags had a single shoulder strap and were designed to be borne by only a single shoulder. Referring to FIG. 1, an example of a golf bag 100 with a single carrying strap system is provided. The golf bag 100 includes an extended tubular enclosure 111 with a closed end 112 and an open end 113 in which golf clubs are inserted into the bag to be carried. The golf bag 100 further includes a handle 114 for lifting the bag and carrying it for a short distance. A side pocket 115 provides storage for non-golf club items, such as towels, clothing, or other articles. Front pocket 116 generally is used to store golf balls, tees, ball markers and other smaller items. Some bags also may have a stand-up mechanism 117 that is activated by a pressure sensitive lever 118 located near the bottom of the bag and allows the bag 100 to be self-standing. A single carrying strap 119 is connected to the extended tubular enclosure 111 at two points. The single carrying strap 119 typically may be adjusted to better fit its carrier using adjustment buckle 120 in conjunction with adjustment strap 121. Pulling adjustment strap 121 away from carrying strap 119 and through buckle 120 will shorten the length of carrying strap 119. An opposite motion lengthens the strap 119. Such strap size adjusting mechanisms and techniques are conventional and well known in the art.

Although single carrying strap golf bags are useful, they force the entire load of a golf bag to be borne by a single shoulder. As a result, after carrying a loaded single strap golf bag for an extended distance, such as when walking the golf course and playing golf, considerable stress typically is placed on the spine due to the uneven distribution of the load. Eventually, dual carrying strap golf bags were developed in order to provide a more even distribution of the weight being carried. Referring to FIG. 2, an example of a prior art dual carrying strap golf bag 200 is provided. The bag 200 includes an elongated tubular enclosure 201 with a closed bottom end 202 and an open top end 203 for inserting golf clubs. Like the single carrying strap golf bag 100 of FIG. 1, the dual carrying strap golf bag 200 of FIG. 2 further may include a carrying handle 204 for lifting the bag and carrying it by hand. The bag 200 typically also has a side pocket 205 for storing articles, such as towels or clothing. The bag 200 also may have a front pocket 206 for storing golf balls, tees, ball markers or other smaller items.

The dual carrying strap golf bag 200 has a dual carrying strap system 207 that includes a first carrying strap 208 and a second carrying strap 209, each strap fitting over one of a user's shoulders. Each of the two straps has an adjustable strap portion looped through a buckle 210 that allows for shortening or lengthening of the straps 208 and 209 in a manner well-known in the art. The dual strap system 207 also includes a connecting ring 211 to which each of the first carrying strap 208 and the second carrying strap 209 is secured.

Although the additional carrying strap allows the bag 200 to be borne by two shoulders, thereby more evenly distributing the load and relieving some of the stress on the spine associated with carrying the single carrying strap golf bag 100, there are still problems associated with these dual strap bags. One problem associated with conventional dual carrying strap golf bags 200 relates to the fact that it is not always easy to locate the second strap and place it over the second shoulder after the first strap has been placed over the other shoulder. Because of the way that the conventional straps typically are connected, the player or caddy often times has to contort their shoulder in such a way as to reach backward at an uncomfortable angle in order to grab the second strap to place it over their shoulder.

In addition, conventional dual carrying strap golf bags typically are not well-suited for carrying using only one of the straps for those instances where the carrier does not wish to use both straps. The second strap 209 typically hangs from dual strap system 207 causing discomfort and annoyance from the strap moving around and brushing up against the body. The presence of this additional loose strap also poses a substantial tripping risk.

These same problems and shortcomings plague other shoulder-borne articles, such as luggage, backpacks, duffle bags, equipment carrying cases, and the like.

Accordingly, it would be useful to provide a dual strap system for golf bags and other shoulder-borne articles that is both easy to place over and remove from both shoulders. It would also be useful to provide a dual carrying strap system that could comfortably and easily accommodate single strap carrying when desired.

BRIEF SUMMARY OF THE INVENTION

The following presents a simplified summary of the invention in order to provide a basic understanding of some aspects of the invention. This summary is not an extensive overview of the invention. It is not intended to identify key or critical elements of the invention, nor is it intended to delineate the scope of the invention. The following summary merely presents some aspects of the invention in a simplified form as a prelude to the more detailed description that follows.

A first aspect of the invention relates to improved shoulder-borne carrying devices. Such devices may include, for example: a housing that is used to at least partially contain one or more objects to be carried; a first shoulder strap that is coupled to the housing; and a second shoulder strap that is movably coupled to the first shoulder strap on one end and coupled to the first shoulder strap or the housing on the other end. In some embodiments, the carrying device may comprise a dual strap golf bag with the second strap being pivotally movable with respect to the first shoulder strap, although other types of carrying devices and/or movable arrangements are possible without departing from the invention. The straps may be coupled to the housing using a plurality of coupling systems that may be the same or different from one another, as well as coupling systems that may or may not be adjustable. The golf bag may also include a base secured to an end of the housing including a one-piece element that extends substantially around the end of the housing and forms a support surface for contacting the ground. Additional aspects of the bag may include a semi-rigid frame extending along the exterior of the bag which allows the housing to retains its shape while being carried using the shoulder straps or when placed on the ground using the base.

A second aspect of the invention relates to methods for carrying shoulder-borne articles, like the shoulder-borne articles described above. In at least one example, the methods may include engaging a shoulder strap assembly to a carrying device that defines a housing for at least partially containing one or more items to be carried. The shoulder strap assembly may include a first shoulder strap member coupled to the housing of a carrying device and a second shoulder strap member coupled to the housing and/or moveably coupled via one or more coupling systems to the first shoulder strap member. The carrying device may be placed upon a user's shoulders in such a manner that the second shoulder strap moves with respect to the first shoulder strap via the coupling system, e.g., by pivoting, during the placement of the carrying device on the shoulders.

Additional aspects of the invention relate to shoulder strap assemblies. Shoulder strap assemblies in accordance with at least some examples of this invention may include a first shoulder strap that has a first end having a first coupling system for engaging with a carrying device, a second end having a second coupling system for engaging with the carrying device, and a first connection joint portion. Such shoulder strap assemblies further may include a second shoulder strap that has a first end having a first coupling system for engaging with the first shoulder strap or a carrying device and a second end having a second connection joint portion that is movably engageable with the first connection joint portion of the first shoulder strap such that the second shoulder strap is movably coupled with respect to the first shoulder strap via the first and second connection joint portions. The movable engagement between the first and second connection joint portions, in at least some examples, may be a rotational or pivotal engagement. In at least some examples, the second connection joint portion may be removably coupled with the first connection joint portion so that the second strap can be freely removed from the first strap at the discretion of the user.

Still additional aspects of the invention relate to methods for engaging shoulder strap assemblies, like those described above, to housings for carrying devices. Such methods may include, for example: engaging a first shoulder strap member to a housing of a carrying device; engaging a first end of a second shoulder strap member to the first shoulder strap member or to the housing of the carrying device; and coupling a second end of the second shoulder strap member to the first shoulder strap member at a movable connection joint such that the second shoulder strap member is movable with respect to the first shoulder strap member at the movable connection joint. In at least some examples, the second shoulder strap member may rotate or pivot with respect to the first shoulder strap member at the movable connection joint, and the second shoulder strap member may be removable from the first shoulder strap member at the movable connection joint.

BRIEF DESCRIPTION OF THE DRAWINGS

A more complete understanding of the present invention and at least some advantages thereof may be acquired by referring to the following description in consideration of the accompanying drawings, in which like reference numbers indicate like features, and wherein.

DETAILED DESCRIPTION OF THE INVENTION

In the following description of various examples of the present invention, reference is made to the accompanying drawings, which form a part hereof, and in which is shown by way of illustration various embodiments in which the invention may be practiced. It is to be understood that other embodiments may be utilized and structural and functional modifications may be made without departing from the scope of the present invention.

An apparatus according to at least some examples of the invention may be embodied as a shoulder strap assembly for carrying shoulder-borne articles and/or as a carrying device that includes such a shoulder strap assembly. The shoulder strap assembly may include dual carrying straps, one strap for each shoulder of the bearer. One skilled in the art will appreciate that the inventive aspects disclosed herein may be applied to a wide variety of different types of carrying devices, including, but not limited to golf bags, backpacks, luggage, duffle bags, equipment carrying cases, and other shoulder-borne carrying devices.

Figure 1:
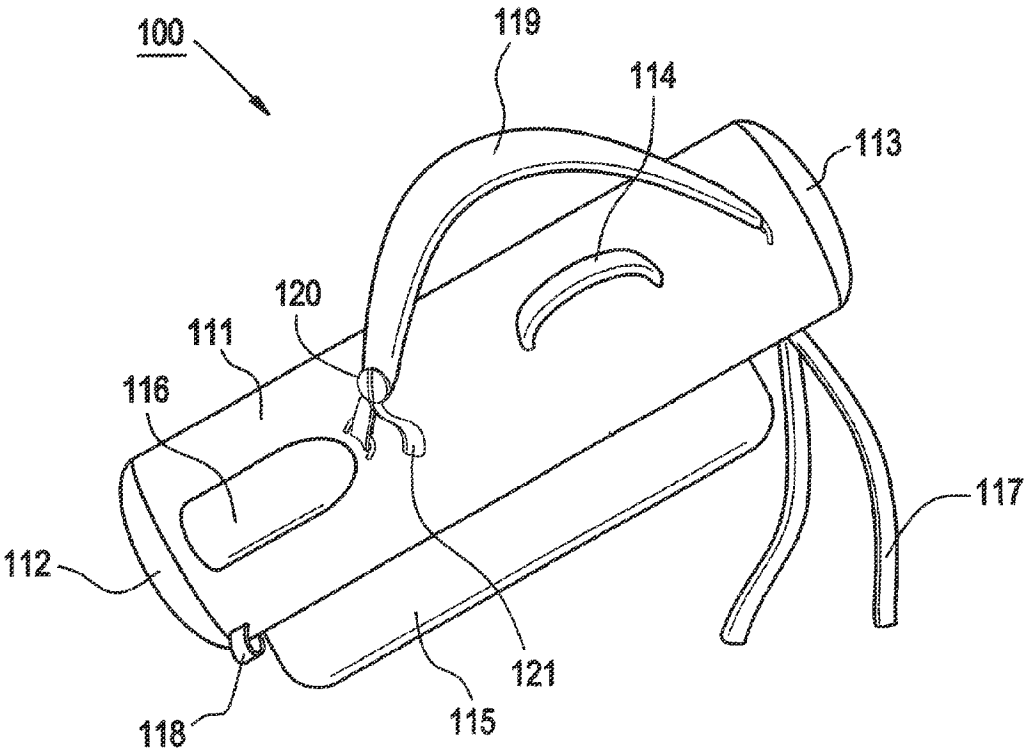
FIG. 1 PRIOR ART
FIG. 1 illustrates an example of a conventional golf bag with a single carrying strap.
Figure 2:
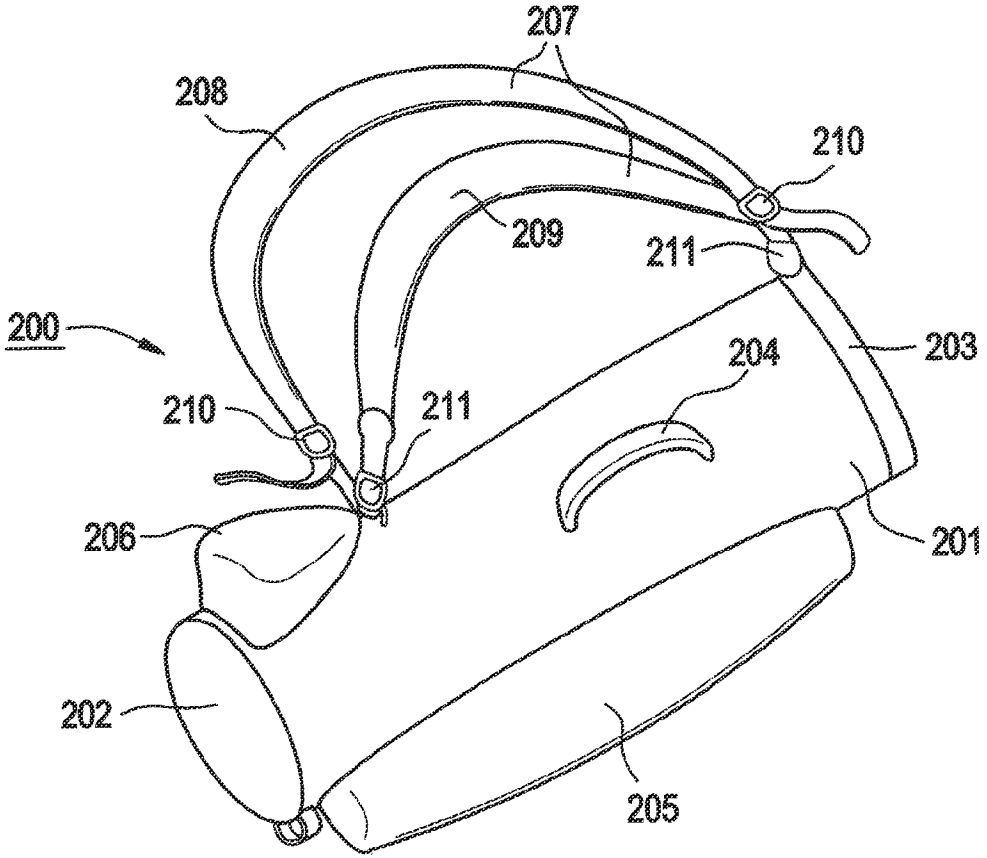
FIG. 2 PRIOR ART
FIG. 2 illustrates an example of a conventional golf bag with dual carrying straps.
Figure 3A:
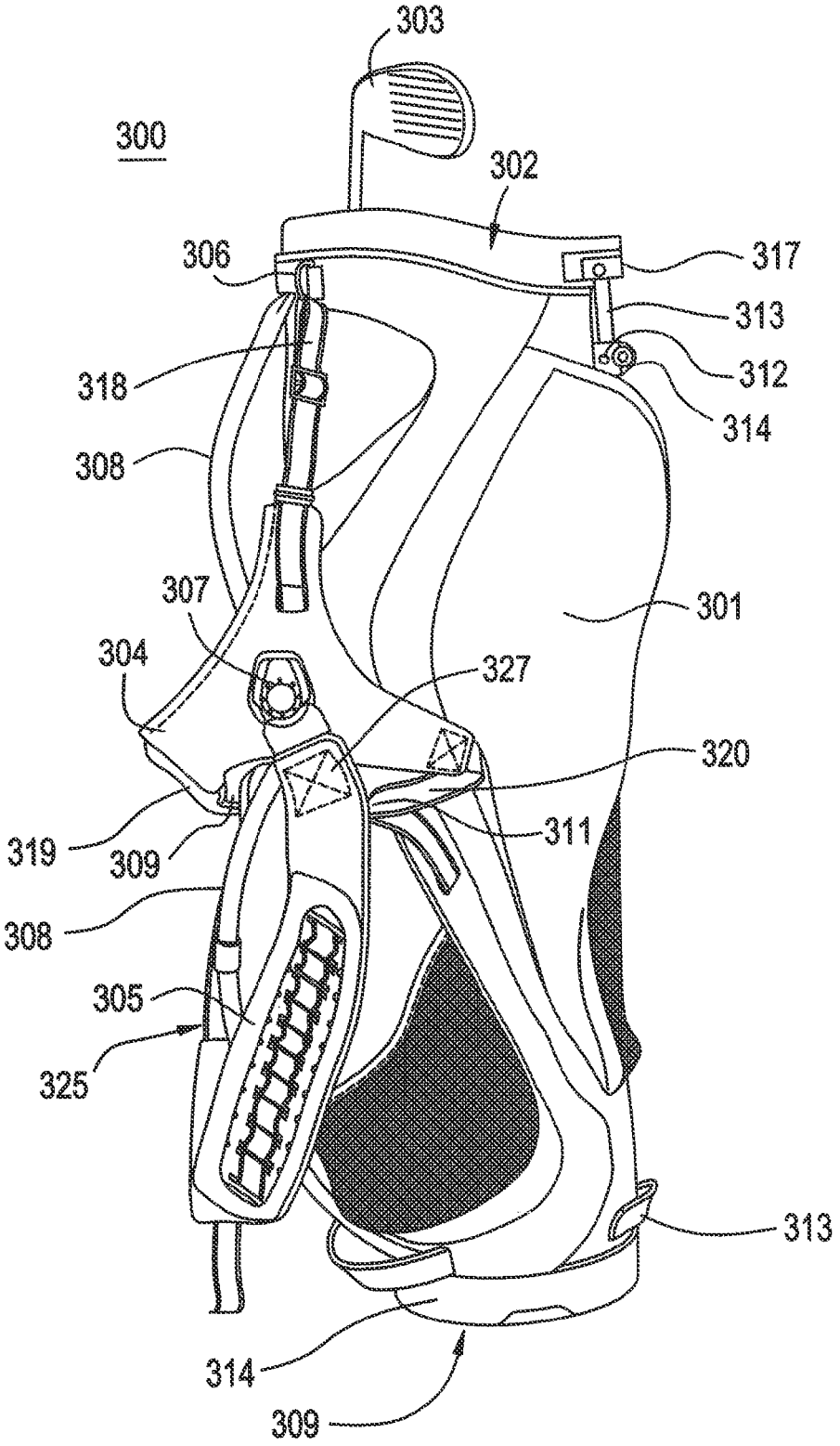
FIGS. 3A and 3B illustrate an example of a golf bag suitable for practicing embodiments of the present invention.
Figure 3B:
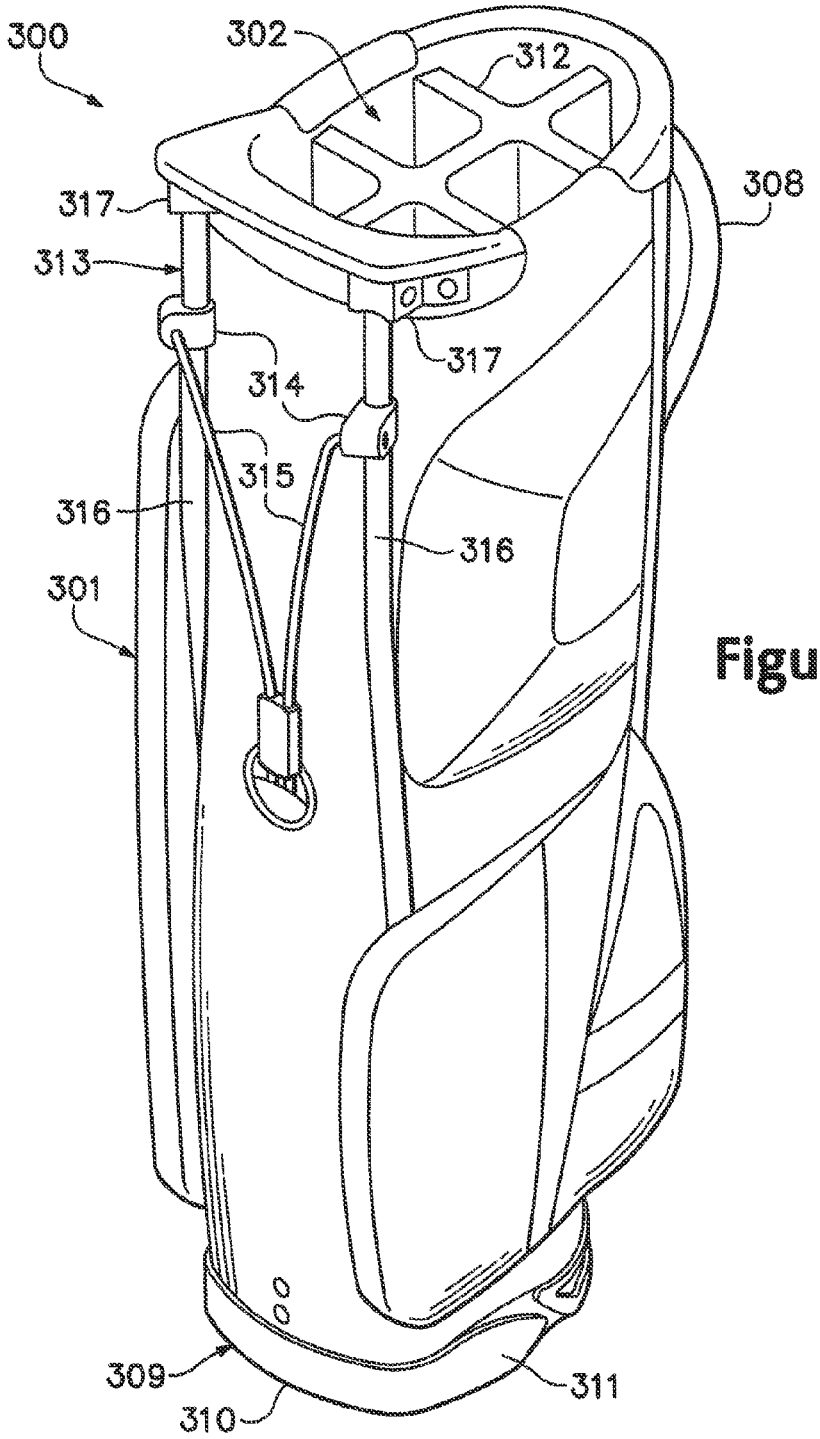

Referring to FIGS. 3A and 3B, an illustration of an example golf bag 300 (from a front viewpoint and a rear viewpoint, respectively) in accordance with aspects of the present invention is provided. The golf bag 300 includes a housing 301 defining a chamber 302 into which items to be carried, such as golf clubs 303, may be placed. A base 309 is secured to housing 301 to provide support and a point of contact between golf bag 300 and the ground. Support assembly 313 is also secured to housing 301 and provides support to golf bag 300 and an additional point of contact with the ground. As will be discussed in greater detail below, base 309 may be formed as a one-piece element that flexes in cooperation with the operation of support assembly 313. Although the structure of base 309 is suitable for use with a golf bag that includes a structure similar to support assembly 313, base 309 may be applied to a variety of other golf bag styles and configurations.

Housing 301 is a hollow structure, with a generally elongate and tubular configuration for receiving golf clubs 303. A variety of materials, textile or otherwise, may form the exterior of housing 301, and pockets may be defined within the materials for receiving other types of golf equipment, including golf balls, tees, towels, ball markers, etc. A divider 312 is secured at an upper end of housing 301 and defines a plurality of apertures that provide access to chamber 302. When in use by an individual, shafts of golf clubs (such as golf club 303) extend through the apertures and along the longitudinal length of housing 301. Heads of golf clubs (such as 303) remain accessible and on the exterior of golf bag 300. Divider 312 may be utilized to organize and prevent damage to the golf clubs. In this regard, divider 312 may be formed of a polymer material, and may have a foam and textile sheath, for example, to provide a yielding and protective surface for contacting the golf clubs. Divider 312 may also incorporate a partition (not shown) that extends between a lower portion of divider 312 and base 309 to further segregate the volume within housing 301 and separate the various golf clubs 303.

A semi-rigid frame 308 extends between divider 312 and base 309 to provide a supporting structure that retains the generally elongate and tubular configuration of housing 301. As shown in FIG. 3A, semi-rigid frame 308 has the configuration of a single shaft that extends along the side of housing 301. In the upper areas of golf bag 300, frame 308 is exposed and curved to define a handle that assists with carrying golf bag 300 and may provide a point of attachment for first shoulder strap 304 (discussed below) and second shoulder strap 305. In lower areas of the golf bag 300, semi-rigid frame 308 may extend into the materials that form the exterior of housing 301. Alternatively, semi-rigid frame 308 may be curved in the lower area as shown in FIG. 3A in order to support the shape and limit collapse of the material elements that form pockets in housing 301. That is, frame 308 may be curved to run adjacent to the exterior of housing 301, thereby providing a rigid structure that assists with retaining the shape of housing 301. Suitable materials for frame 308 include a variety of polymer materials, graphite, wood, fiberglass, and lightweight metals, such as aluminum, for example. In further embodiments, frame 308 may have the configuration of multiple stay rods that extend between divider 312 and base 309.

The bag 300 also includes a first shoulder strap 304 coupled to housing 301 by way of one or more coupling systems 306. In the illustrated example of FIG. 3A, a first end 318 of the first shoulder strap 304 is coupled to housing 301 at or near the open end of the housing 301. A second end 319 of the first shoulder strap 304 extends around the far side of golf bag 300 (not shown in FIG. 3A) and also is coupled to the housing 301 at or near the open end of housing 301. A third end 320 of first shoulder strap 304 is coupled to semi-rigid frame 308 approximately midway between the open and closed ends of the housing 301, at or near the closed end of the housing 301, and/or at any other suitable or desired location along the housing 301.

A first end 325 of the second shoulder strap 305 also is coupled to housing 301 or to the first shoulder strap 304 by one or more coupling systems 306. In some examples, the first end 325 of the second shoulder strap 305 may be coupled to the housing 301 at any desired location, including, for example, at or near the location where the third end 320 of first shoulder strap 304 is coupled to housing 301 or to the semi-rigid frame 308. Alternatively, the first end 325 of the second shoulder strap 305 may be coupled to the first shoulder strap 304 at any suitable or desired location, including, for example, at or near a location where the third end 320 of the first shoulder strap 304 attaches to the housing 301.

Any suitable or desired coupling system 306 may be used to couple the straps 304 and/or 305 to the housing 301 or to one another without departing from the invention, including conventional coupling systems for coupling straps to housings or other devices as are known in the art. For example, one or more of the coupling systems 306 may be an adjustable coupling system, with straps or buckles that can be used to adjust the length of the straps to better fit a carrier's body type. The coupling systems 306 may include clasps, hooks, devises, shackles, snap arrangements, or other mechanisms that allow the straps to be securely and/or easily connected, and/or mechanisms that allow the straps to be easily and/or selectively adjustable and/or removable from the housing 301 without departing from the invention. Additionally, the coupling systems 306 may directly or indirectly couple the shoulder straps 304 and/or 305 to the housing 301 without departing from the invention, and each coupling system 306 may be the same as or different from one another without departing from the invention. Furthermore, in some examples, the first shoulder strap 304 and the second shoulder strap 305 may share a common connection to the housing 301 without departing from the invention.

The other end 327 of second shoulder strap 305 is movably coupled to first shoulder strap 304. The coupling of second shoulder strap 305 to first shoulder strap 304 may be provided by a coupling system 306. Any suitable manner of movably coupling the first shoulder strap to the second shoulder strap may be used without departing from the invention. For example, in some embodiments, the coupling system 306 may comprise a movable connection joint 307 that allows the second shoulder strap 305 to move with respect to the first shoulder strap 304 at movable connection joint 307. If desired, both ends 325 and 327 of the second shoulder strap 305 may be movably coupled to the first shoulder strap 304 or to the housing 301 using a movable connection of this type without departing from the invention.

Figure 4A:
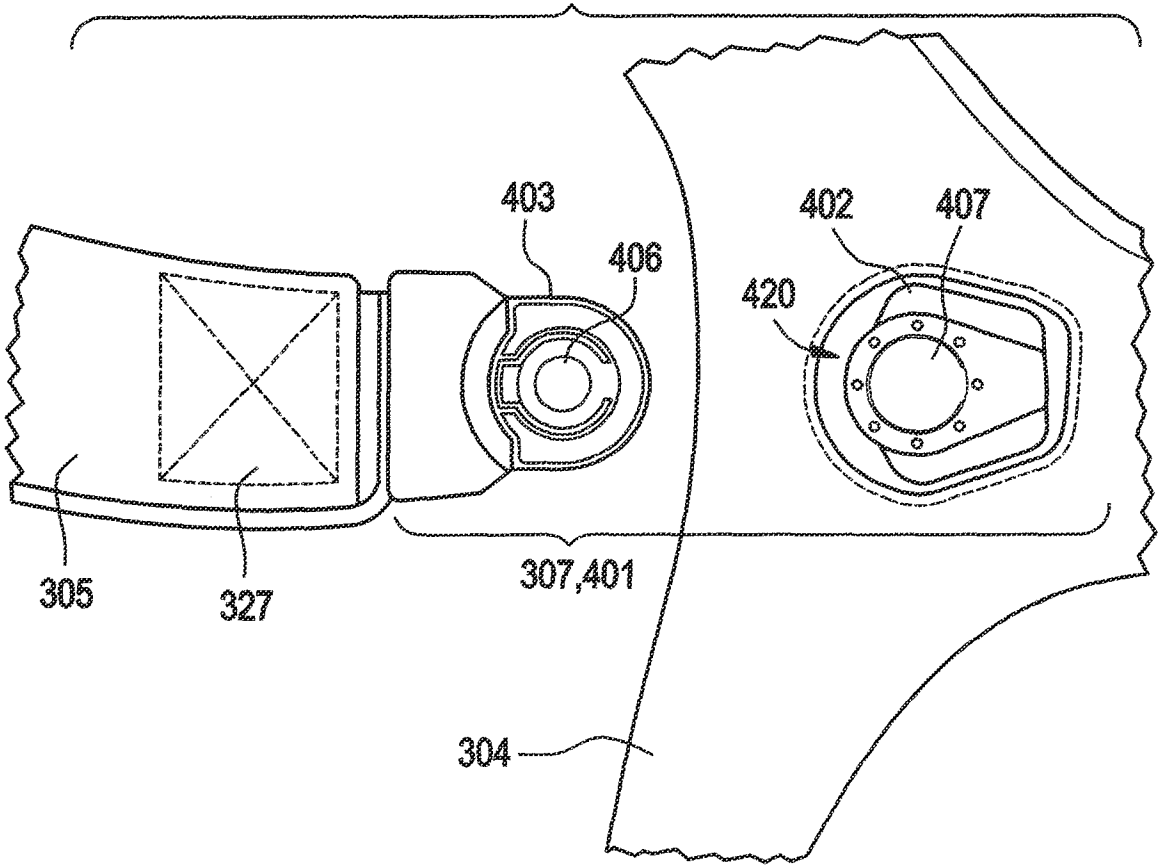
FIGS. 4A through 4D illustrate overhead and side views of a pivotable engagement assembly in both engaged and disengaged positions according to one or more aspects of the invention.
Figure 4B:
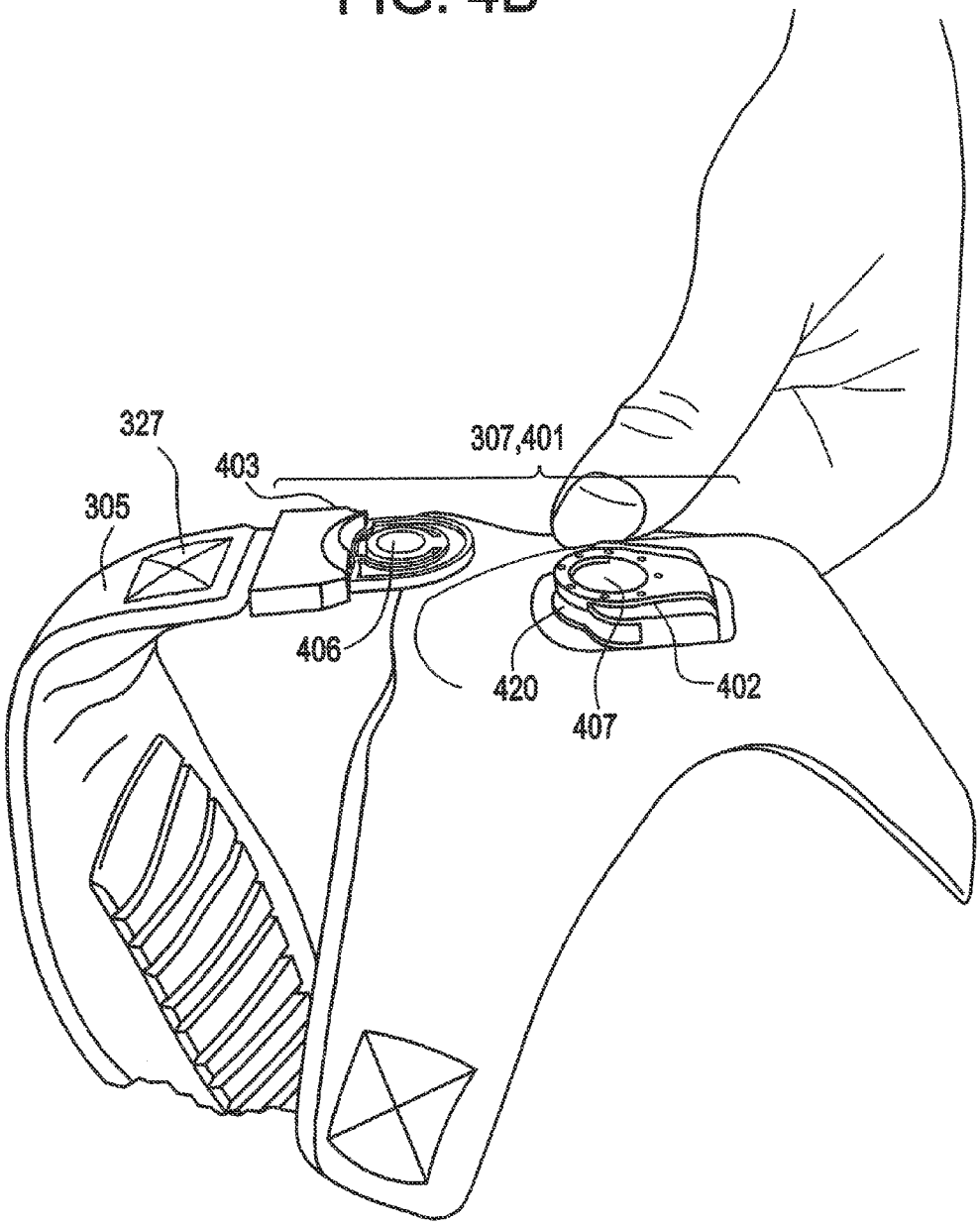
Figure 4C:
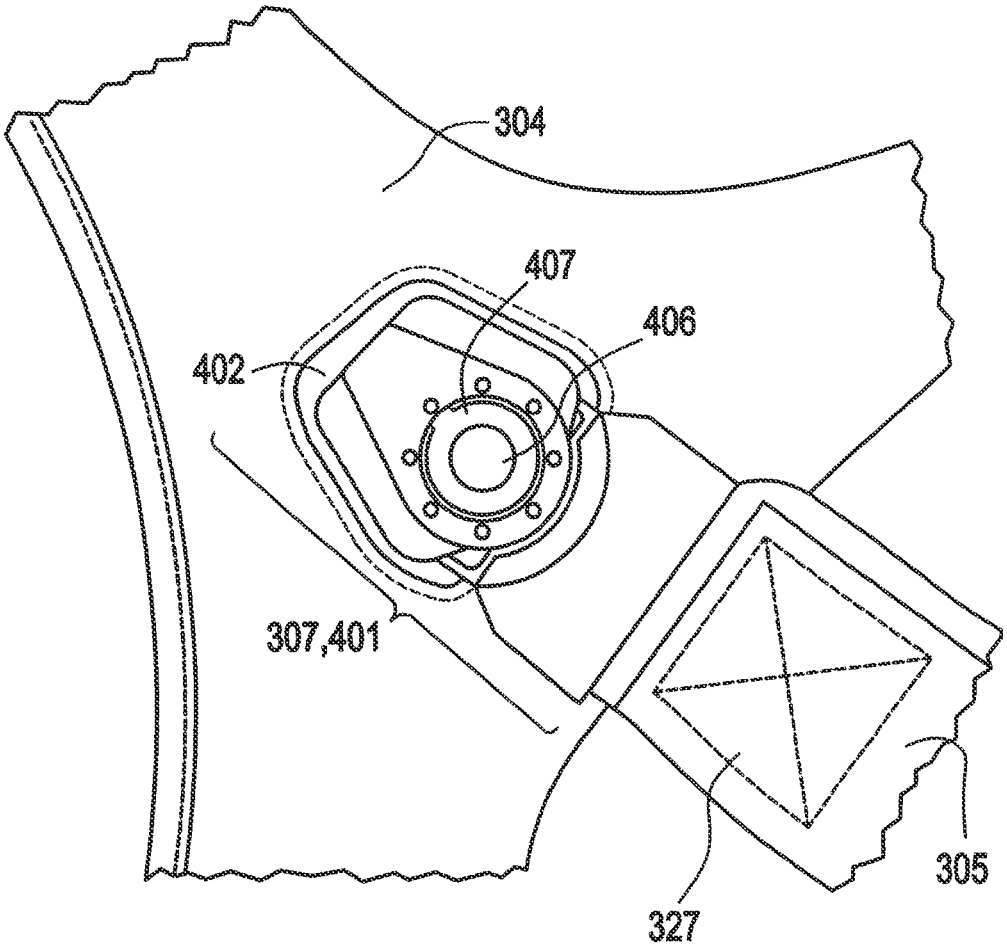
Figure 4D:
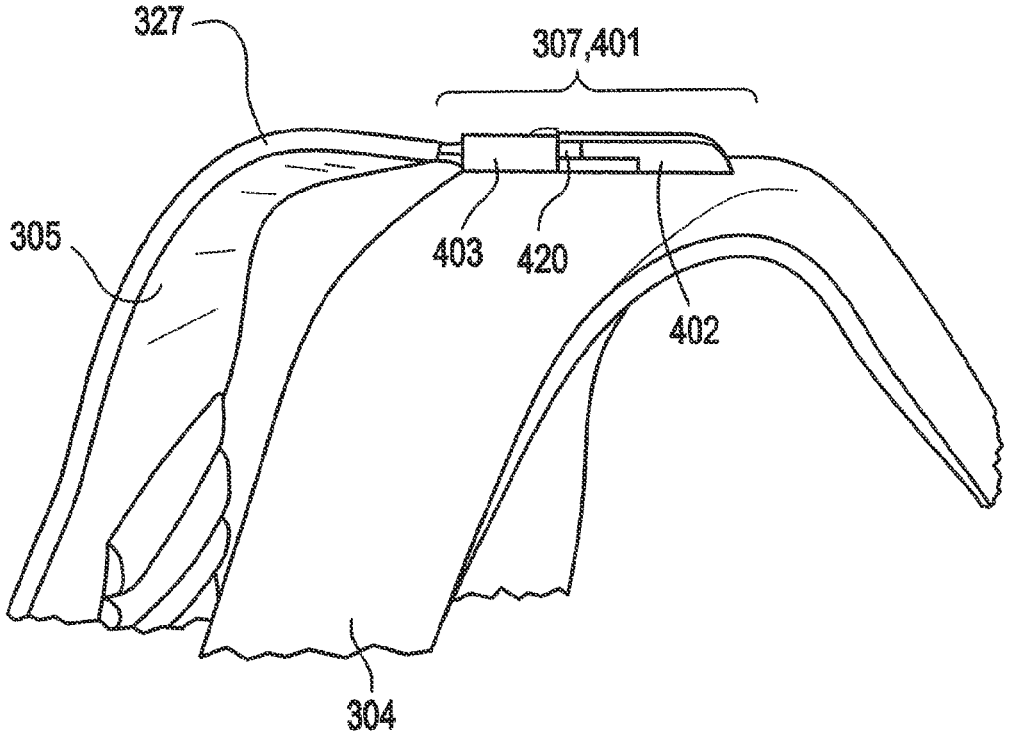

In one embodiment of the invention, movable connection joint 307 comprises a pivot snap buckle. FIGS. 4A through 4D illustrate overhead and side views of an example movable connection joint 307 that comprises a pivotable engagement assembly in the form of a pivot snap buckle 401. FIGS. 4A and 4B illustrate the movable connection joint 307 in a disengaged position (an overhead view and a side view, respectively), while FIGS. 4C and 4D illustrate the movable connection joint 307 in an engaged position (an overhead view and a side view, respectively). As illustrated, the connection joint 307, which is in the form of a pivot snap buckle 401 in this example, may have two or more components. The first connection joint portion or component is a component 402 that is fixedly or removably attached to primary strap 304. In one embodiment, receptor component 402 is a plastic molding that defines an opening or slot 420 into which another part of the connection joint portion is received (see FIGS. 4B and 4D). However, as would be apparent to one of skill in the art, receptor component 402 may take other forms or be made from other materials without departing from the spirit and scope of the present invention. For example, in other embodiments, receptor component 402 may be made of a metallic material or, alternatively, of some kind of fabric. As still another example, the opening or slot 420 may be defined between a portion of the connection joint portion and the strap member 304. Other arrangements and configurations are possible without departing from the invention.

A second component of the connection joint (e.g., the pivot snap buckle 401) according to this example of the invention is snap-in piece 403 that may be fixedly or removably attached to secondary strap 305. As shown by comparing FIGS. 4A and 4B with FIGS. 4C and 4D, respectively, and as will be explained in more detail below, inserting snap-in piece 403 connected to secondary strap 305 into receptor component 402 of the primary strap 304 causes snap-in piece 403 to snap into place within the receptor component 402, thus the coupling primary strap 304 with the secondary strap 305.

In some embodiments, snap-in piece 403 may be removably engaged within the receptor component 402 such that the secondary strap 305 may be disengaged from the primary strap 304 and/or removable from the housing 301 by the user. In one example, snap-in piece 403 may include a raised and movable button 406 that compresses inward as it is slid through the opening or slot 420 defined in the receptor component 402. Once through the slot 420 and located within the opening 407 defined in the receptor component 402, the movable button 406 snaps back outward into place inside the opening 407 of the receptor component 402 by elevating outward toward its original position. In this manner, the outer edges of button 406 engage with and are trapped within opening 407, thereby holding the button 406 within the opening 407. The snap-in piece 403 may be removed from receptor component 402 by depressing button 406 until its edges are below opening 407 and then sliding the snap-in piece 403 out of receptor component 402.

Figure 5B:
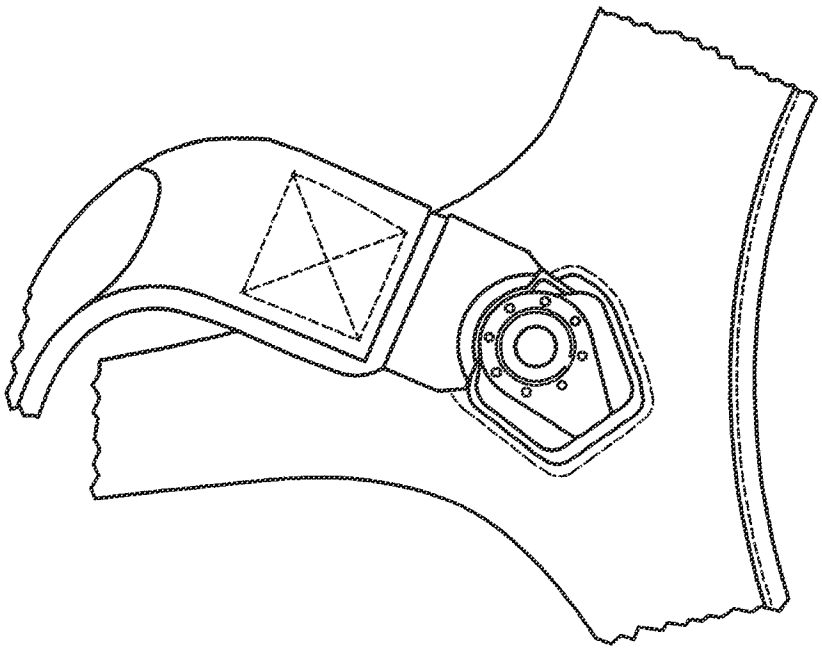
FIGS. 5A and 5B illustrate a pivotal engagement assembly in accordance with aspects of the invention in various rotational positions.
Figure 5A:
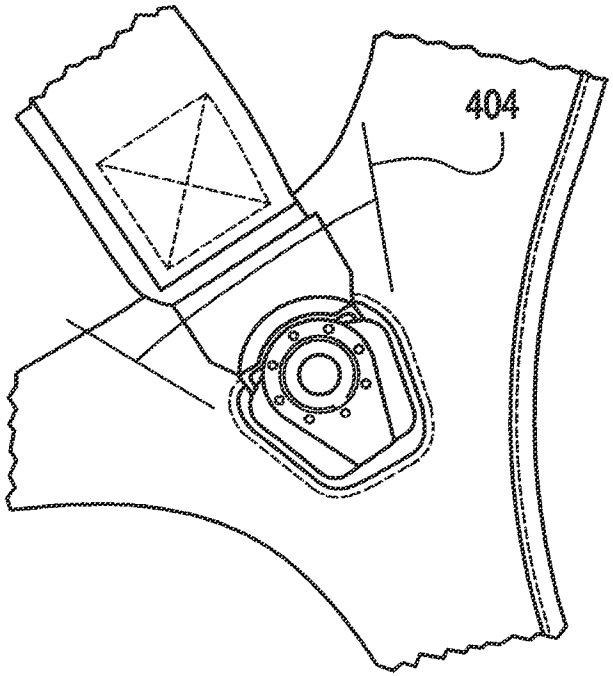

The receptor component 402 of pivot snap buckle 401 also may provide a range of available rotation 404. As shown in FIGS. 5A and 5B, in this example, in order to provide a range of motion 404, the slot 420 of receptor component 402 may be enlarged as compared to the thickness of the snap-in piece 403 such that the snap-in piece 403, upon snapping into place, has space to rotate within the slot 420 of the receptor component 402. Thus, according to an aspect of the invention, when snap-in piece 403 is inserted into receptor component 402, because of the round button 406 shape and the round opening 407 shape, the snap-in piece 403 is able to rotate within receptor component 402, thereby causing secondary strap 305 to move with respect to primary strap 304. The range of motion 404 may be limited, if desired, in any suitable manner, for example, by providing or molding stops into the material associated with the receptor component 402, into the slot 420, and/or on the snap-in component 403; by changing the track or slot 420 size in the direction of rotation; or in any other suitable or desired manner, including in conventional manners known in the art. Various embodiments of the invention may include various available ranges of rotation 404. For example, in one or more embodiments, the range of available rotation 404 may be relatively small, such as approximately 10 degrees, for example, so that secondary strap 305 does not fall too far toward the ground when not positioned on a shoulder. In other embodiments, the range of rotation 404 may be greater, ranging from 10 to 90 degrees of rotation, or in some examples, from 20 to 60 degrees of rotation. In still other embodiments, a range of available rotation 404 may be 360 degrees of rotation to allow a maximum range of movement for secondary strap 305 with respect to the primary strap 304.

Figure 6B:
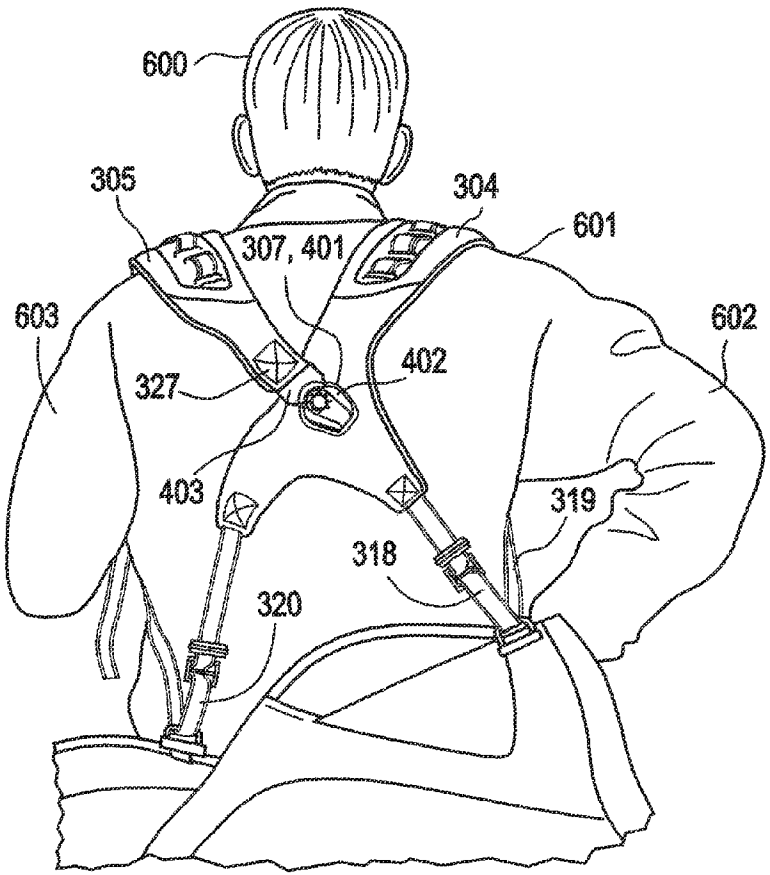
FIGS. 6A and 6B illustrate a user carrying a bag wherein a strap has been placed over a shoulder using a pivot snap buckle assembly according to one or more aspects of the invention.
Figure 6A:
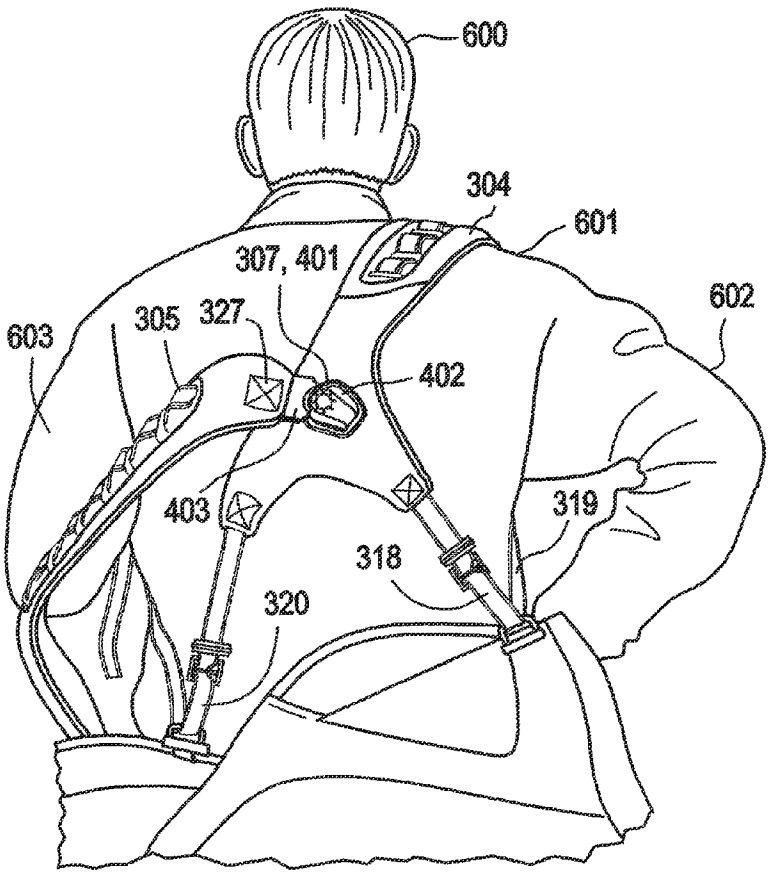

There are at least two benefits derived from this movable connection. First, the carrier of the golf bag can more easily locate and place the second strap 305 over the second shoulder after the first strap 304 has been placed on the first shoulder. Referring to FIGS. 6A and 6B, a user 600 is shown carrying a bag that embodies one or more aspects of the invention. In FIG. 6A, the user 600 has placed primary strap 304 over his/her primary shoulder 601. Depending upon whether the user is right-handed or left-handed, the user 600 may use his/her left shoulder as their primary shoulder or he/she may user his/her right shoulder as the primary shoulder. The user 600 places primary strap 304 over primary shoulder 601 by extending his/her primary arm 602 through an opening provided between primary strap 304 and housing 301. Secondary strap 305 rotates downward at the movable connection 307 under the force of gravity and the weight of the strap to hang down toward the user's secondary side.

In the illustrated example, movable connection 307 connects secondary strap 305 to primary strap 304. In this specific illustrated example, coupling system 306 comprises pivot snap buckle 401, including snap-in component 403 (affixed to secondary strap 305) and receptor component 402 (affixed to primary strap 304). This movable connection 307 provides a range of rotation, as described above. By rotating and moving the secondary strap 305 downward (e.g., under the force of gravity and the weight of the strap), this allows secondary strap 305 to fall further away from the primary strap 304 and lower, toward the user's secondary side. In this manner, the secondary strap 305 is located in closer proximity to the secondary arm 603 of the user 600. This closer proximity allows user 600 to more easily locate the secondary strap 305 and extend his/her secondary arm 603 through the opening between secondary strap 305 and housing 301, which thereby allows the user 600 to more easily slip his/her arm through secondary strap 305 and raise the strap 305 for placement of the strap 305 over the secondary shoulder, as shown in FIG. 6B. Similarly, the user 600 may more easily remove each of primary shoulder strap 304 and secondary shoulder strap 305 by taking advantage of movable connection 307 that includes the pivotable engagement assembly. User 600 may rein in secondary arm 603 such that it no longer extends through the opening between secondary strap 305 and housing 301. Upon doing so, secondary shoulder strap 305 may pivot inside of the pivotable engagement assembly, under the force of gravity, resulting in the secondary strap 305 falling away from the secondary shoulder and away from the primary shoulder strap 304. The user 600 then can more easily remove the primary strap 304 from the primary shoulder without interference from or tangling with the secondary strap 305.

While the invention has been described with respect to specific examples including presently preferred modes of carrying out the invention, those skilled in the art will appreciate that there are numerous variations and permutations of the above described systems and techniques. For example, the pivotable engagement assembly need not take on the specific pivot snap buckle 401 form as described above. Any suitable or desired pivotable or rotational connection may be used without departing from the invention. For example, the secondary strap may be rotationally or pivotally attached to the primary strap by a ball-and-socket type joint or other pivotal joint arrangement. Additionally, while the movable connection is freely engageable and disengageable in the examples illustrated and described above, if desired, a permanent or fixed connection may be employed without departing from the invention.

Additionally, the assembly that movably engages the secondary strap to the primary strap need not be pivotal arrangement. For example, the secondary strap may include a peg, a stud, or other connector that slidably (and optionally removably) engages within a track defined in or attached to the primary strap. The track may be linear, curved, stepped, or otherwise configured, and it may be oriented in any suitable or desired manner (e.g., such that gravity will automatically separate the shoulder straps as described above). The track may provide a limited range of movement for the secondary strap with respect to the primary strap. In addition, the relative movement of the secondary strap with respect to the primary strap need not be limited to one or two dimensional motion. Any suitable or desired connection that provides relative movement of one strap member with respect to another strap member and/or any suitable or desired arrangement that provides a limited range of movement of one strap with respect to the other, e.g., to provide easy donning and removal of a carrying device from a user's shoulders, may be used without departing from the invention.

The straps themselves also can have any suitable or desired construction without departing from the invention, including conventional constructions (e.g., with foam or other cushioning material to improve comfort) known to those skilled in the art. In addition to foam and/or other cushioning material, one or more fluid-filled bladders may be incorporated into the straps, e.g., to reduce weight and/or further improve comfort. In general, the fluid-filled bladders may be a fluid that is sealed within an envelope formed from a polymer material, such as a thermoplastic elastomer, that is substantially impermeable to the fluid. The fluid contained by the bladder may vary, including, for example, gases or liquids, such as: hexafluoroethane, sulfur hexafluoride, octafluoropropane, nitrogen, and air, optionally under ambient pressure or at an elevated pressure. In addition, a pump system may be employed that permits the individual to selectively pressurize the bladder to a desired pressure. Strap constructions of the type described in U.S. patent application Ser. No. 10/341,773 (Wolfe, et al., filed Jan. 13, 2003) and/or U.S. patent application Ser. No. 10/705,731 (Collier, et al., filed Nov. 11, 2003) may be used in at least some examples of the present invention. These U.S. patent applications are entirely incorporated herein by reference.

Figure 7:
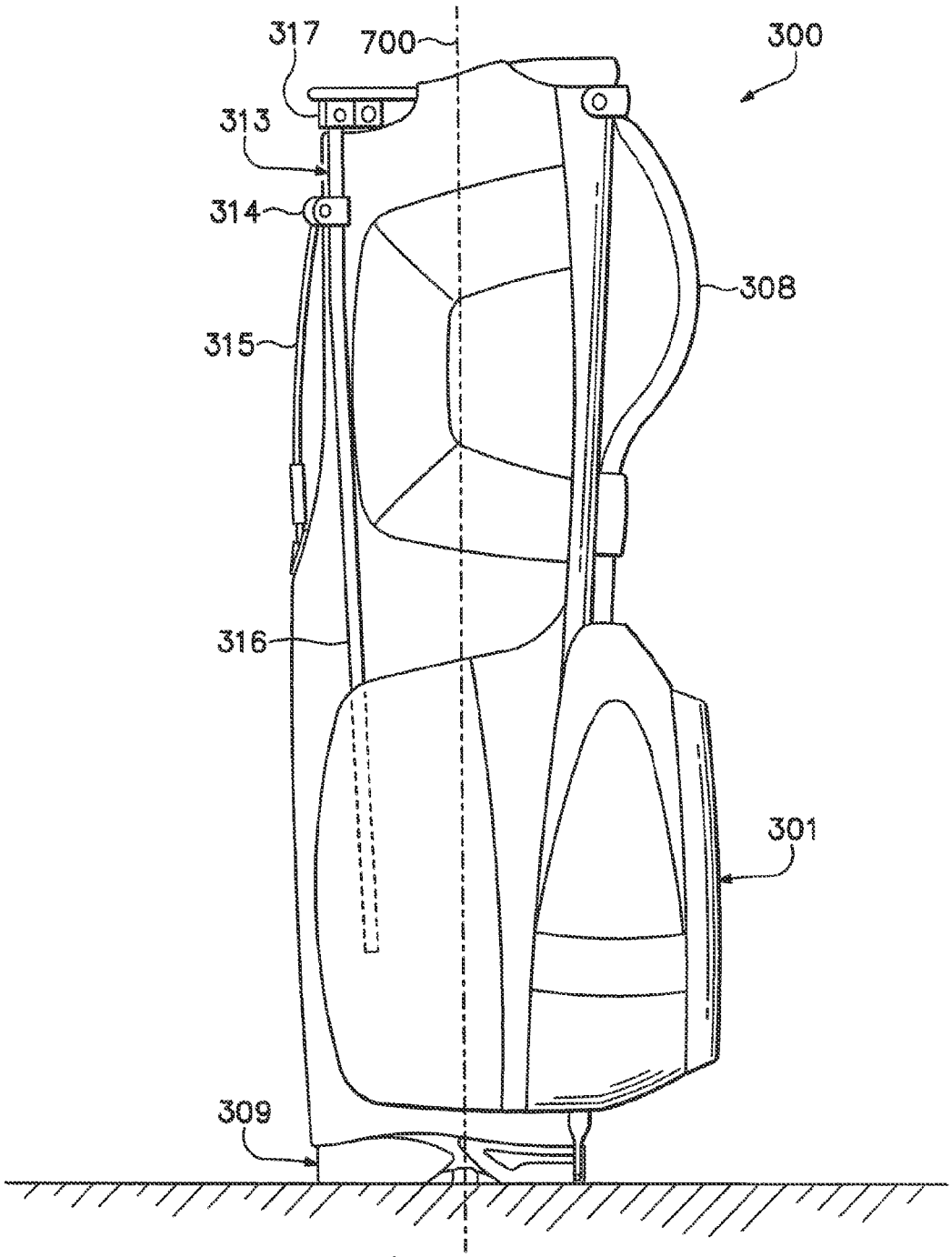
FIG. 7 is a side elevational view of a golf bag including aspects of the invention in an upright configuration.
Figure 8:
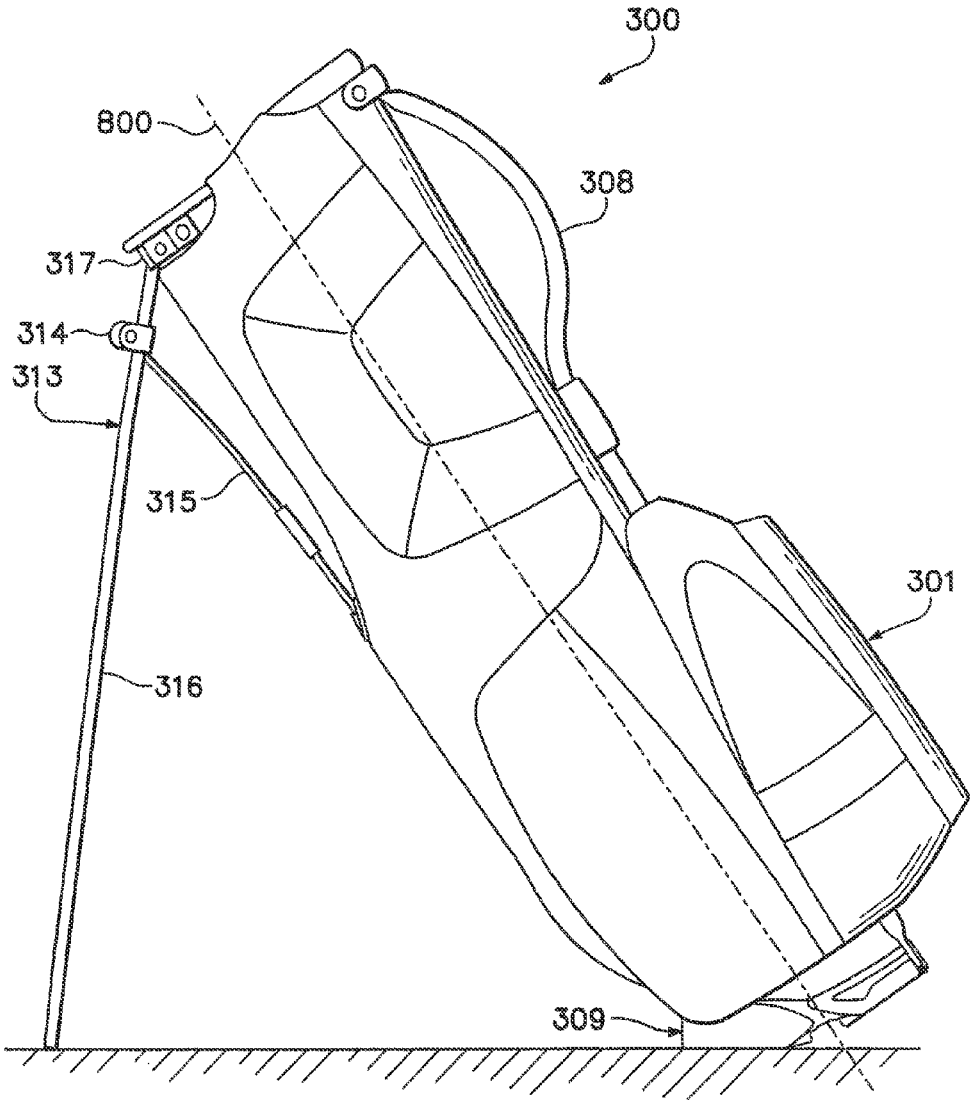
FIG. 8 is a side elevational view of the golf bag including aspects of the invention in an inclined position.

Additional aspects of the invention relate to features of the bag base 309, which may be used in combination with dual carrying strap assemblies like those described above. As an individual progresses around a golf course, golf bag 300 and the golf clubs 303 located within housing 301 are carried from one location to another location. At each location, the individual may place golf bag 300 on the ground while selecting a suitable golf club and striking a golf ball. If a particular location is generally level and provides a stable surface, golf bag 300 may rest upon the ground in an upright position, as depicted in FIG. 7, wherein base 309 forms the primary contact point between golf bag 300 and the ground. If a particular location is not level or will not provide a stable surface, golf bag 300 may rest upon the ground in an inclined position, as depicted in FIG. 8, wherein support assembly 313 and base 309 cooperatively form the points of contact between golf bag 300 and the ground.

Additionally referring back to FIGS. 3A and 3B, support assembly 313 includes a pair of legs 316, and a pair of leg attachment points 317. Legs 316 are pivotally secured to housing 301 at leg attachment points 317, which may be formed integral with divider 312 or may be formed as a separate bracket that is attached to housing 301 and adjacent divider 312. An upper portion of actuator 315 is secured to each of legs 316 at actuator attachment points 314, which are spaced downward from leg attachment points 317. A portion of actuator 315 may extend through a sheath formed by the material of housing 301, and a lower portion of actuator 315 is secured to base 309 as described below. See also U.S. Pat. No. 6,386,362 to Cheng, which is hereby incorporated by reference.

Figure 9:
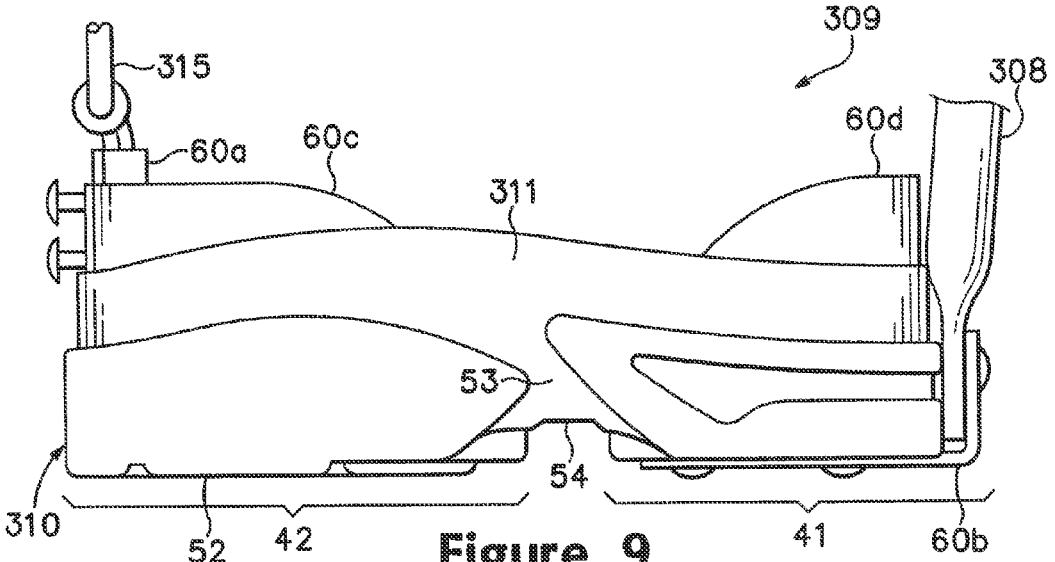
FIG. 9 is a side elevational view of the base in a non-flexed configuration that corresponds with the upright configuration of the golf bag depicted in FIG. 7.
Figure 10:
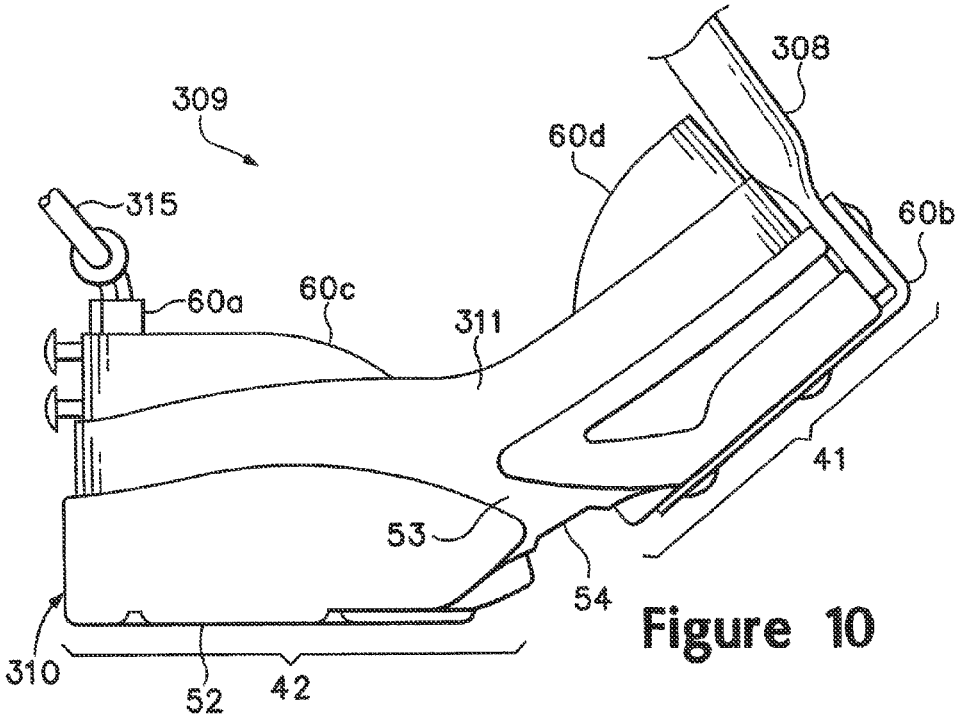
FIG. 10 is a side elevational view of the base in a flexed configuration that corresponds with the inclined configuration of the golf bag depicted in FIG. 8.
Figure 11:
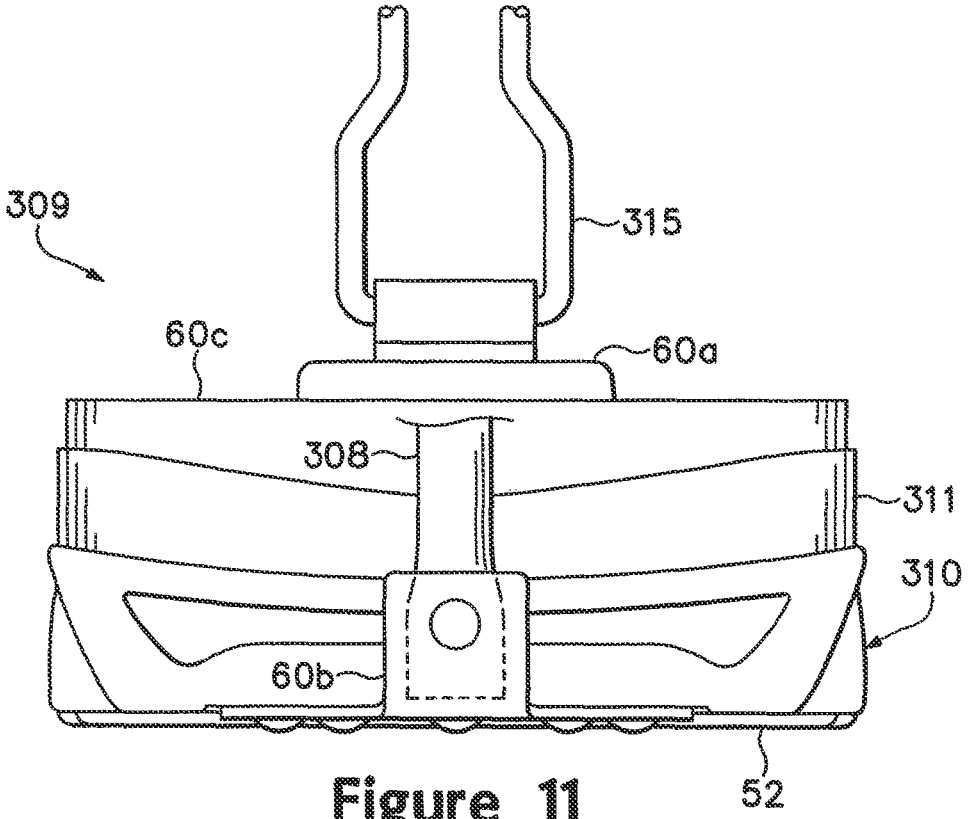
FIG. 11 is a front elevational view of the base.
Figure 12:
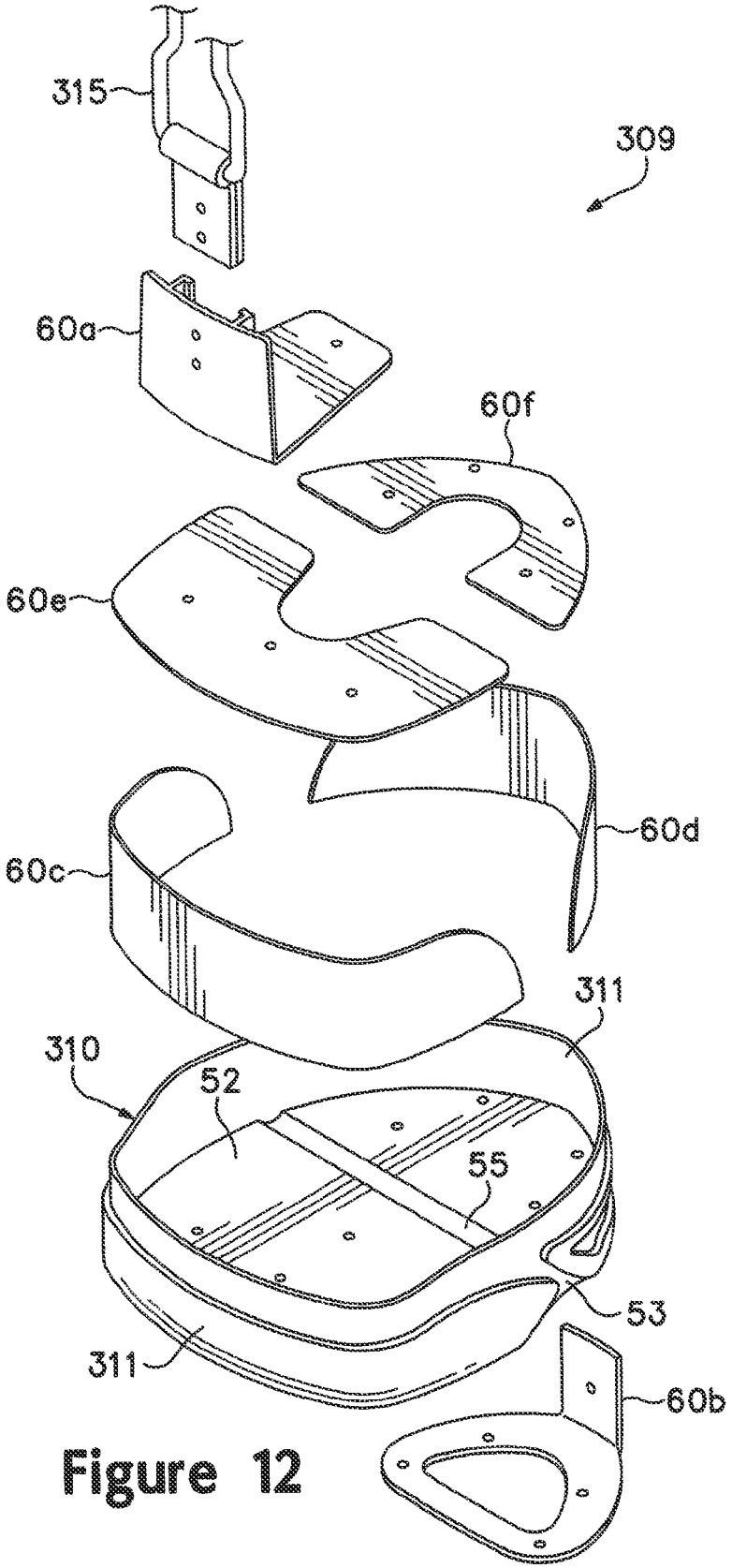
FIG. 12 is an exploded perspective view of the base.
Figure 13:
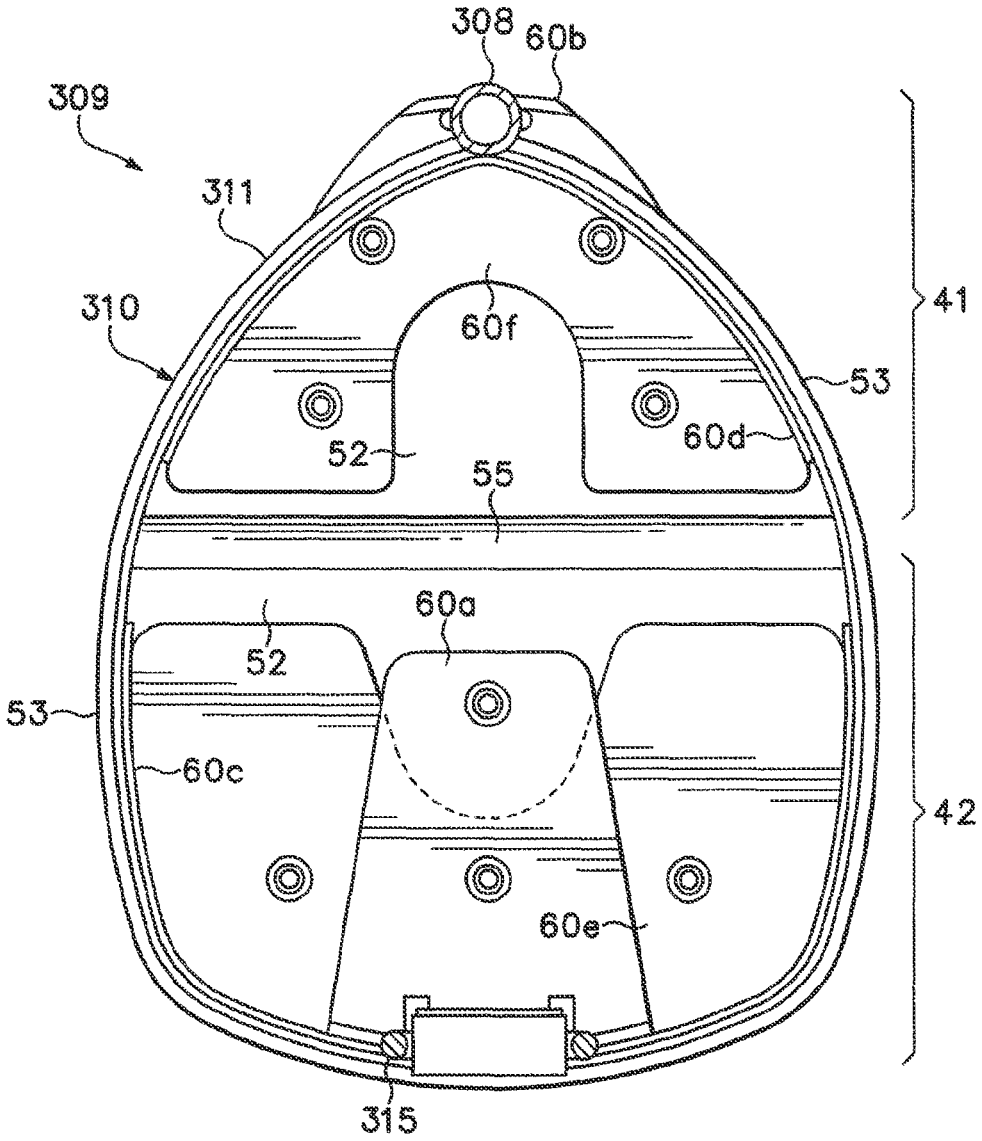
FIG. 13 is a top plan view of the base.
Figure 14:
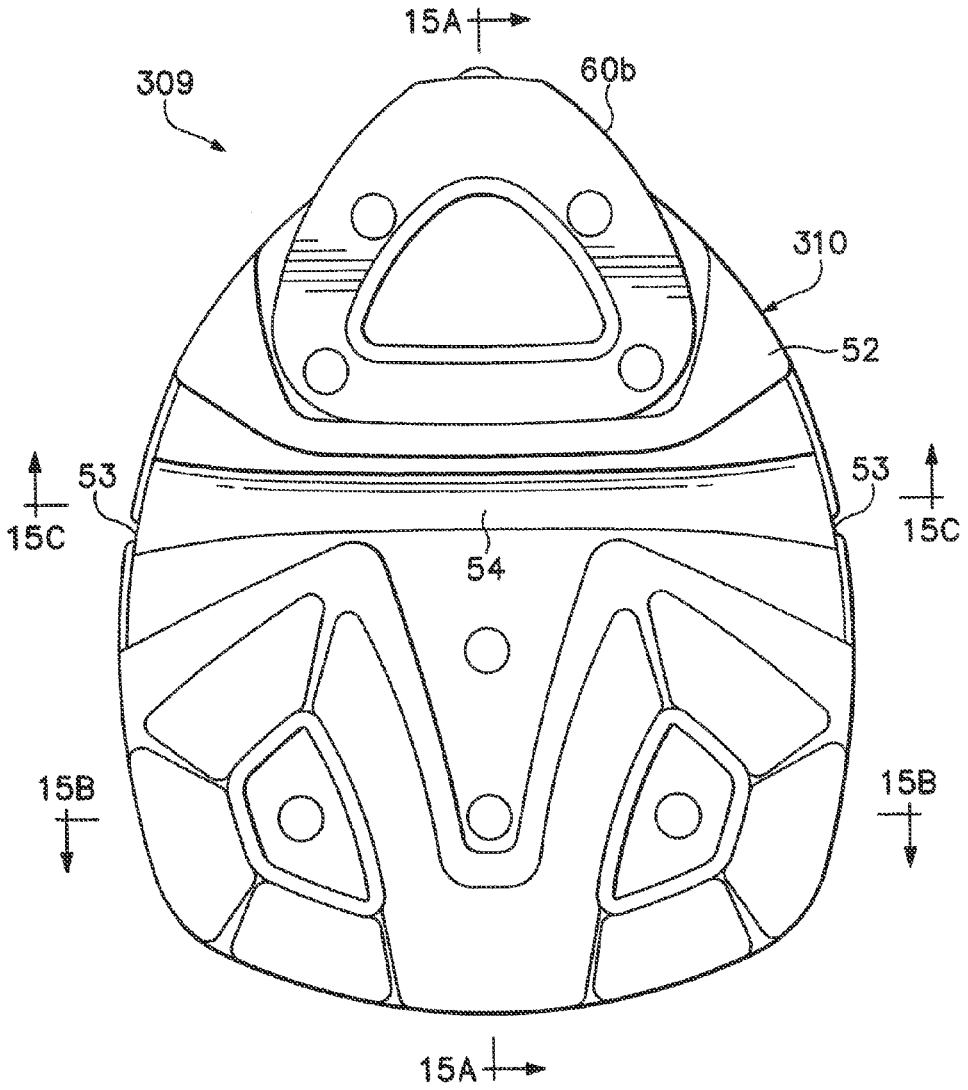
FIG. 14 is a bottom plan view of the base.
Figure 15A:
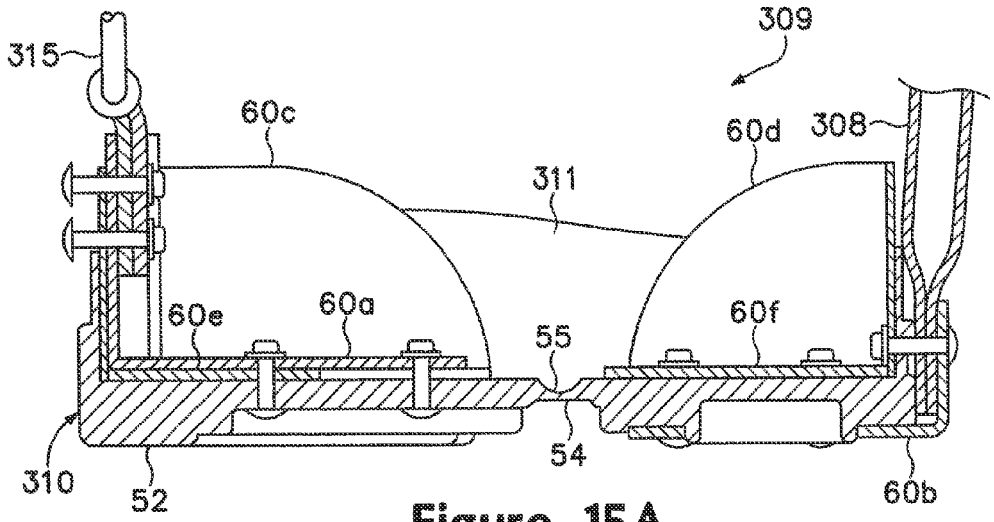
FIG. 15A is a first cross-sectional view of the base, as defined along section line 15A-15A in FIG. 14.
Figure 15B:
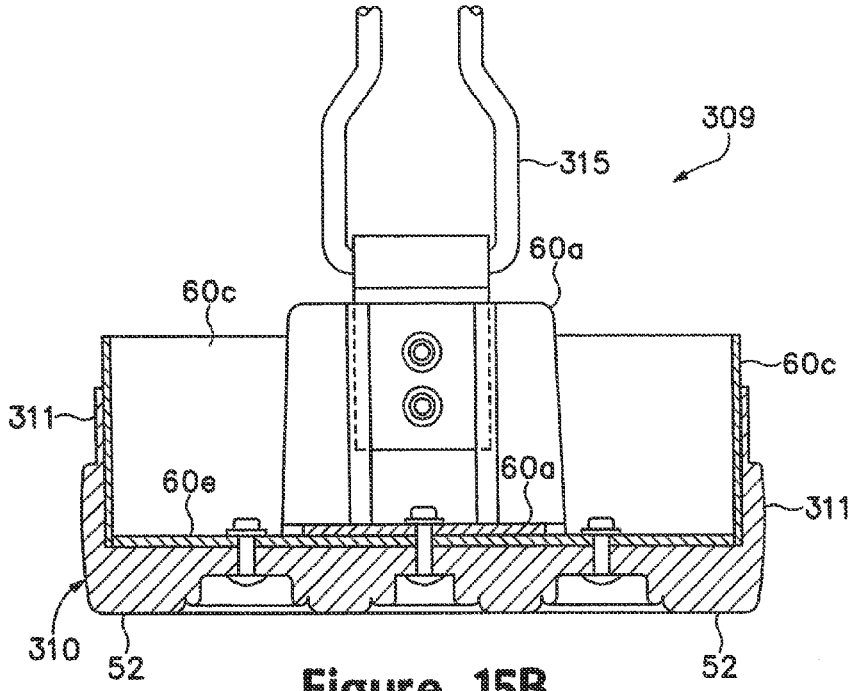
FIG. 15B is a second cross-sectional view of the base, as defined along section line 15B-15B in FIG. 14.
Figure 15C:
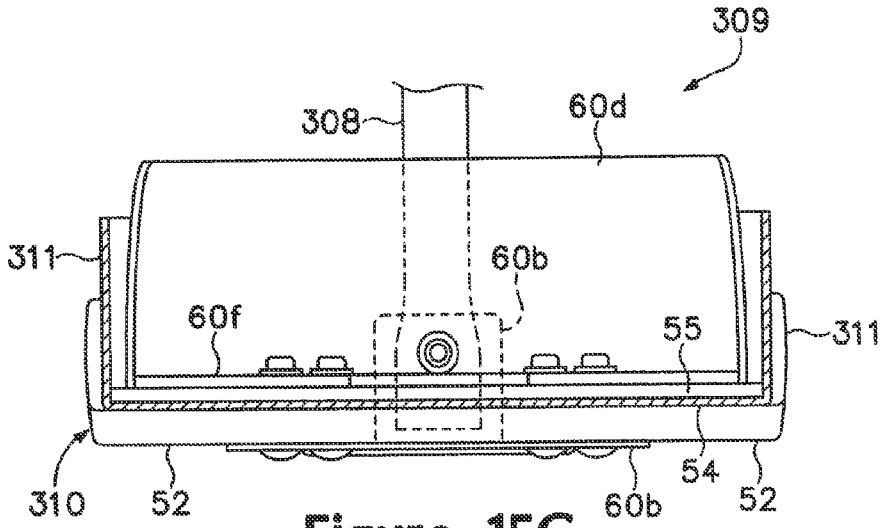
FIG. 15C is a third cross-sectional view of the base, as defined along section line 15C-15C in FIG. 14.
Figure 16:
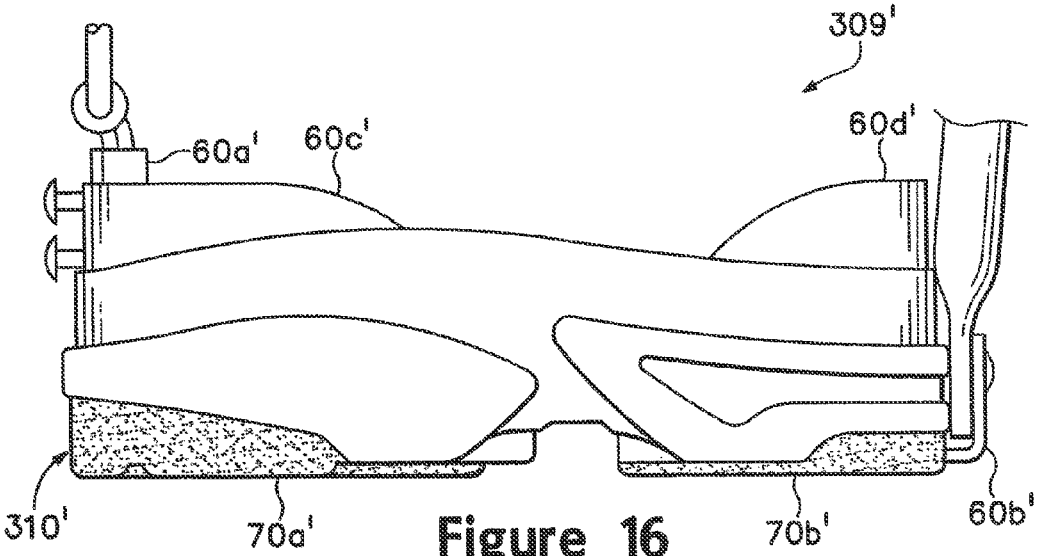
FIG. 16 is a side elevational view of another base in accordance with aspects of the present invention.
Figure 17:
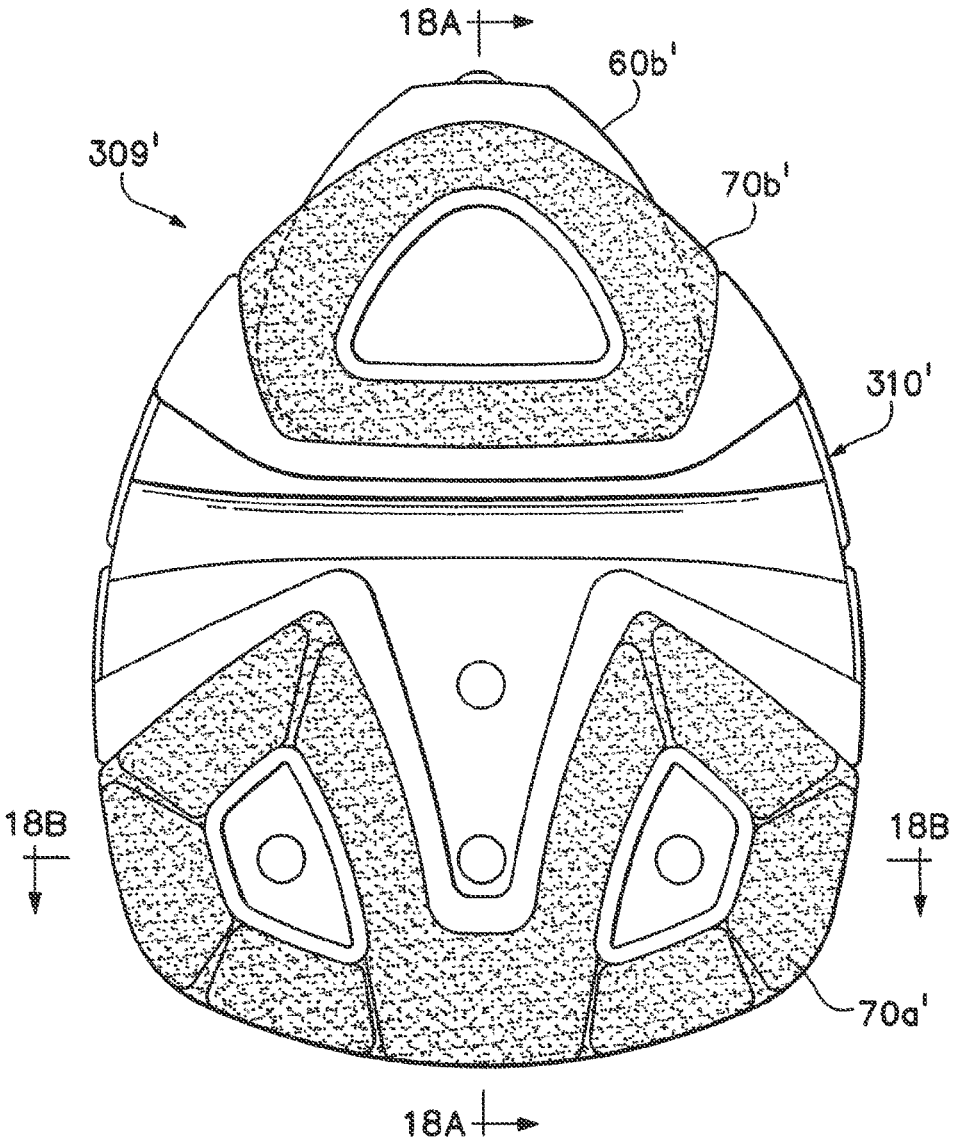
FIG. 17 is a bottom plan view of the base depicted in FIG. 16.
Figure 18A:
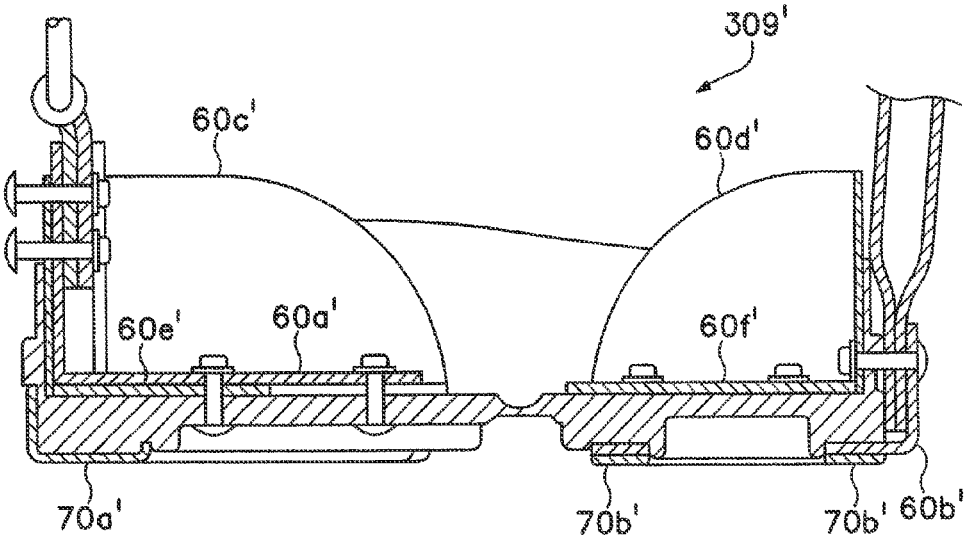
FIG. 18A is a cross-sectional view of the base depicted in FIG. 16, as defined along section line 18A-18A in FIG. 17.
Figure 18B:
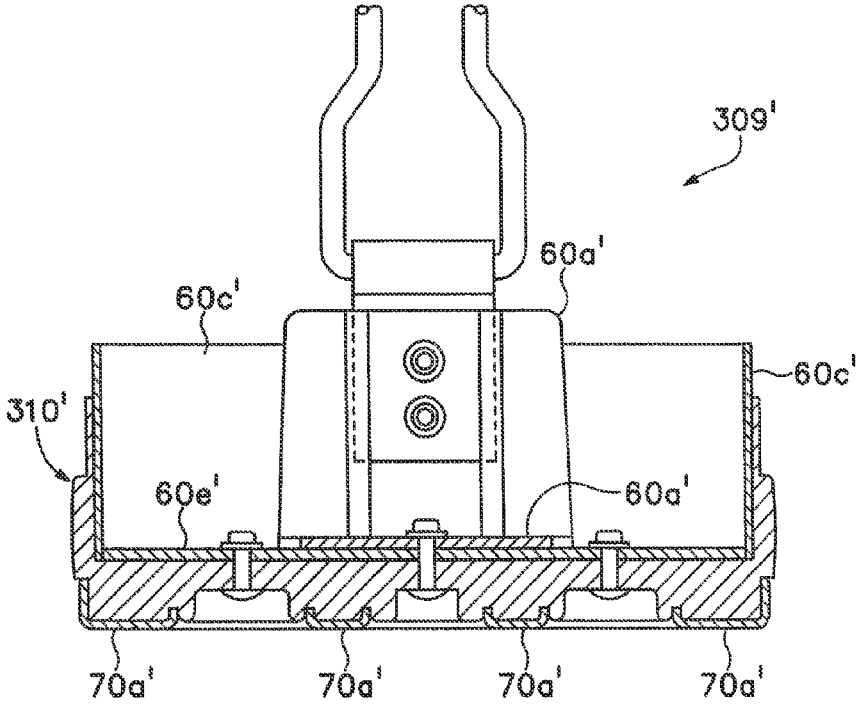
FIG. 18B is a cross-sectional view of the base depicted in FIG. 16, as defined along section line 18B-18B in FIG. 17.

The features of support assembly 313 described above permit golf bag 300 to stand in the upright position or in the inclined position. In the upright position, which is depicted in FIG. 7, a longitudinal axis 700 of housing 301 is substantially perpendicular to the ground, legs 316 are positioned adjacent to the exterior surface of housing 301, and golf bag 300 rests solely upon base 309. With regard to the configuration of base 309 in the upright position, substantially the entire lower surface of base 309 contacts and is parallel to the ground, and base 309 has the non-flexed configuration depicted in FIG. 9. In the inclined position, which is depicted in FIG. 8, longitudinal axis 800 of housing 301 is obliquely-positioned with respect to the ground, legs 316 extend obliquely away from housing 301, and golf bag 300 rests upon both base 309 and the ends of legs 316. With regard to the configuration of base 309 in the inclined position, a rear portion 41 of base 309 flexes or pivots upward with respect to a front portion 42 such that only front portion 42 remains in contact with the ground, as depicted in FIG. 10. Accordingly, base 309 flexes when golf bag 300 is placed in the inclined position.

The manner in which golf bag 300 is set upon the ground determines whether golf bag 300 stands in the upright position or the inclined position. When the individual intends to have golf bag 300 in the upright position, golf bag 300 is set upon the ground such that longitudinal axis 700 is perpendicular to the ground and substantially the entire lower surface of base 309 contacts the ground. This procedure ensures that the weight of golf bag 300 and the golf equipment contained by golf bag 300 is distributed to place golf bag 300 in the upright position. When the inclined position is desired, however, golf bag 300 may be set upon the ground such that the weight of golf bag 300 and the golf equipment are distributed over front portion 42 of base 309. This procedure causes housing 301 to rotate forward, which causes rear portion 41 to pivot relative to front portion 42. As rear portion 41 pivots, actuator 315 induces an upward force in legs 316, thereby causing legs 316 to rotate outward from housing 301. Accordingly, rotating housing 301 forward causes base 309 to flex and causes legs 316 to rotate outward, which places golf bag 300 in the inclined position.

The configuration of golf bag 300 described above provides a structure that permits golf bag 300 to rest upon the ground in either the upright position or the inclined position. Base 309 is structured to flex and facilitate a change from the upright position to the inclined position. More specifically, base 309 provides the sole point of contact with the ground when golf bag 300 is in the upright position. When golf bag 300 is in the inclined position, however, base 309 flexes such that rear portion 41 pivots upward and the ends of legs 316 contact the ground. Accordingly, base 309 operates in conjunction with support assembly 313 to support golf bag 300 in either the upright or inclined position.

Base 309 includes a contact element 310 and a plurality of connecting elements 60*a*-60*f*, as depicted in FIGS. 9-15C. In general, contact element 310 is formed of a flexible material, such as a polymer foam, that extends substantially around and closes the lower end of housing 301, thereby preventing golf equipment from extending through the lower end. Given that contact element 310 may be formed from a polymer foam, connecting elements 60*a*-60*f* reinforce or otherwise provide durable areas for securing base 309 to housing 301 and support assembly 313. Each of contact element 310 and connecting elements 60*a*-60*f* will be discussed in greater detail below.

Contact element 310 includes a sidewall 311 and a support surface 52. Sidewall 311 is depicted as being formed integral with support surface 52, which enhances the durability of base 309. In further embodiments, however, sidewall 311 and support surface 52 may be formed as separate elements and subsequently joined together. Sidewall 311 extends upward from support surface 52, and support surface 52 extends across the area defined by sidewall 311, thereby forming a generally concave structure. Upper portions of sidewall 311 may have a reduced thickness in comparison to lower portions of sidewall 311, as depicted in the cross-sections of FIGS. 15A-15C. The reduced thickness may be utilized, for example, to compensate for the thickness of the materials of housing 301 that extend over the upper portions of sidewall 311 and are stitched to sidewall 311. The lower portions of sidewall 311 are generally thicker than the upper portions, but may have an area 53 of reduced thickness on each side and positioned generally at the interface between rear portion 41 and front portion 42 to facilitate flexing or pivoting of rear portion 41 with respect to front portion 42. The upper edge of sidewall 311 may exhibit a planar configuration, or may be contoured. Similarly, the exterior surface of sidewall 311 may have a uniform appearance, or may be contoured for aesthetic or functional reasons. Accordingly, the specific configuration of sidewall 311 may vary significantly within the scope of the present invention.

Support surface 52 generally forms a lower surface of golf bag 300 and is positioned to contact the ground. As with sidewall 311, the thickness of support surface 52 is selected to facilitate flexing or pivoting of rear portion 41 with respect to front portion 42. In general, the portion of support surface 52 located adjacent the front and rear of golf bag 300 have a greater thickness than central portions. More specifically, an area 54 that forms the interface between rear portion 41 and front portion 42 has a reduced thickness as compared to other areas of support surface 52. The reduced thickness of area 54 provides greater flexibility in area 54 than in other areas of support surface 52, thereby promoting flex. In addition to the reduced thickness, an indentation 55 extends across support surface 52 at the interface between rear portion 41 and front portion 42, thereby forming a flexion line that also promotes pivoting of rear portion 41 with respect to front portion 42. Indentation 55 is depicted in the figures as having a curved or semi-circular shape, but may also have other shapes within the scope of the present invention.

In addition to facilitating flexing or pivoting of rear portion 41 with respect to front portion 42, the thickness of support surface 52 may also be selected to compensate for expected wear that may occur as golf bag 300 is utilized and repeatedly set upon the ground. The various ground surfaces that may come into contact with support surface 52 include, for example, concrete, rock, dirt, and grass. Accordingly, the overall thickness of support surface 52, particularly in areas that may experience the greatest degrees of wear, may range from 5 to 10 millimeters, for example. Depending upon the specific structure and the material utilized for contact element 310, however, the thickness may depart from this range.

The material forming contact element 310 may be a polymer foam that is shaped through a conventional casting process, wherein a mold is utilized to impart the desired configuration. In this regard, contact element 310 may be formed from materials that include polyurethane or ethylvinylacetate foam. A suitable hardness for the ethylvinylacetate foam may be, for example, in a range of 60-64 on the Asker C scale. These types of polymer foam have advantages over conventional materials utilized in a golf bag base, which are generally formed from dense, non-foamed polymer materials. Polymer foam materials attenuate impact forces and absorb energy when base 309 contacts the ground. When a full set of golf clubs and other golf equipment is contained by housing 301, golf bag 300 may weigh in excess of 25 pounds. Accordingly, considerable forces may be developed when golf bag 300 is placed upon the ground. A polymer foam material may be utilized, therefore, to cushion or otherwise reduce such forces, thereby protecting the golf clubs and other golf equipment.

A further benefit of the polymer foam material relates to the stability and flexibility provided by base 309. The dense, non-foamed polymer materials incorporated into many of the conventional golf bag bases exhibit a relatively thin cross-section. Although the conventional base is lightweight, the polymer materials are generally non-flexible. The polymer foam of contact element 310, however, imparts sufficient stability while retaining flexibility. The property of flexibility is particularly suitable for contact element 310, which flexes as rear portion 41 pivots with respect to front portion 42. Although advantages are gained from utilizing a polymer foam for contact element 310, a variety of other materials, such as non-foamed polymers, may be utilized to form contact element 310.

Connecting elements 60*a*-60*f* reinforce or otherwise provide durable areas for securing base 309 to housing 301 and support assembly 313. In addition, connecting elements 60*a*-60*f* may provide additional stability or rigidity to base 309. Connecting element 60*a* is positioned within front portion 42 and provides a connector between actuator 315 and base 309. As depicted in the figures, connecting element 60*a* has a generally L-shaped configuration, with one segment extending along the interior of sidewall 311 and the other segment extending along the interior of support surface 52. Connecting element 60*a* also includes a connector that receives a lower end of actuator 315 and secures actuator 315 to base 309. A plurality of rivets or an adhesive, for example, may be utilized to secure connecting element 60*a* to contact element 310.

Connecting element 60*b* is positioned within rear portion 41 and provides a connector between frame 22 and base 309. As with connecting element 60*a*, connecting element 60*b* is depicted as having a generally L-shaped configuration, with one segment extending along the exterior of sidewall 311 and the other segment extending along the exterior of support surface 52. A rivet, for example, may extend through connecting element 60*b* and frame 22 to securely connect frame 22 to base 309. Whereas connecting element 60*a* is positioned adjacent the interior surface of contact element 310, contact element 60*b* is positioned adjacent the exterior surface. In order to provide a flush, finished appearance to the interface between connecting element 60*b* and contact element 310, an indentation may be formed in contact element 310 to receive connecting element 60*b*.

The materials that form a portion of housing 301 may be secured to base 309 through stitching or adhesives, for example. As depicted in the figures, however, stitching is utilized. When contact element 310 is formed of a polymer foam material, the thread utilized to stitch the materials to contact element 310 may eventually cut or otherwise pull through the foam material. In order to provide reinforcement, therefore, connecting elements 60*c* and 60*d* extend at least partially around the upper edge of sidewall 311. Although a single connecting element may be utilized, connecting elements 60*c* and 60*d* are separated by a space that facilitates pivoting of rear portion 41 with respect to front portion 42.

Connecting elements 60*e* and 60*f* extend along the interior area of support surface 52. Each of connecting elements 60*e* and 60*f* may provide additional rigidity to base 309. In addition, connecting elements 60*e* and 60*f* may reinforce areas where the partition, which may extend between divider 312 and base 309 to separate the various golf clubs, is secured to base 309. Whereas connecting element 60*e* is positioned in front portion 42, connecting element 60*f* is positioned in rear portion 41. This configuration forms a space between connecting elements 60*e* and 60*f* to facilitate flexing of base 309. In some embodiments of the invention, connecting elements 60*e* and 60*f* may be omitted or reduced in size, particularly when no partition is present.

A variety of materials are suitable for connecting elements 60*a*-60*f*, including various polymers and metals. More particularly, connecting elements 60*a*-60*f* may be formed from a nylon, polypropylene, or polyurethane material, or connecting elements 60*a*-60*f* may be formed from a high flex modulus polyether block amide, such as PEBAX, which is manufactured by the Atofina Company. Polyether block amide provides a variety of characteristics that benefit the present invention, including high impact resistance at low temperatures, few property variations in the temperature range of −40° C. to +80° C., resistance to degradation by a variety of chemicals, and low hysteresis during alternative flexure. Another suitable material for connecting elements 60*a*-60*f* is a blend of polyether block amide and nylon with 23% glass reinforcement. Furthermore, connecting elements 60*a*-60*f* may be formed from a polybutylene terephthalate, such as HYTREL, which is manufactured by E.I. duPont de Nemours and Company. Composite materials may also be formed by incorporating glass fibers or carbon fibers into the polymer materials discussed above in order to enhance the strength of connecting elements 60*a*-60*f*. A textile material may also be utilized alone or in conjunction with connecting elements 60*c* and 60*d*.

The specific configuration of base 309 disclosed above provides one example of the many base configurations that fall within the scope of the present invention. As noted above, this configuration may be used in combination with dual carrying strap assemblies like those described above to provide an easy-to-carry and self-standing golf bag or other carrying device.

Other base configurations also are possible without departing from the invention, including additional configurations usable with dual carrying strap assemblies like those described above. For example, referring to FIGS. 16-18B, another configuration of a base 309' is illustrated. As discussed above, wear to base 309 may occur as golf bag 300 is utilized and repeatedly set upon the ground. Although the polymer foam material selected for base 309 may provide suitable wear-resistance, additional wear resistance may be added, as depicted with reference to base 309'. The primary components of base 309' are a contact element 310', connecting elements 60*a*'-60*f*, and a pair of wear elements 70*a*' and 70*b*'. Contact element 310' and connecting elements 60*a*'-60*f* have the general configuration of contact element 310 and connecting elements 60*a*-60*f* Accordingly, contact element 310' is formed of a polymer foam material and includes a sidewall 311' and a support surface 52'. Wear elements 70*a*' and 70*b*' are secured to support surface 52' in areas that experience relatively high degrees of wear. Portions of wear elements 70*a*' and 70*b*' may also extend onto sidewall 311'.

The configuration of base 309', and particularly the materials forming contact element 310' and wear elements 70*a*' and 70*b*', is analogous to a sole structure of a conventional article of athletic footwear. In general, a sole structure of athletic footwear includes a midsole and an outsole secured to a lower surface of the midsole. The midsole is formed of a polymer foam, such as ethylvinylacetate or polyurethane foam, that attenuates impact forces and absorbs energy as the sole structure is compressed against the ground. The outsole is formed of a rubber material that is generally considered to be highly wear-resistant and durable. Accordingly, the outsole is positioned to contact the ground. With respect to base 309', therefore, wear elements 70*a*' and 70*b*' may be positioned to contact the ground and provide the wear-resistant properties imparted by a conventional footwear outsole. In contrast with base 309, therefore, wear element 70*b*' extends over connecting element 60*b*'. The material forming wear elements 70*a*' and 70*b*' may be formed of materials that include carbon black rubber compound. Wear elements 70*a*' and 70*b*' may be secured to contact element 310' through a variety of conventional attachment techniques that utilize adhesives or mechanical fasteners.

Figure 19:
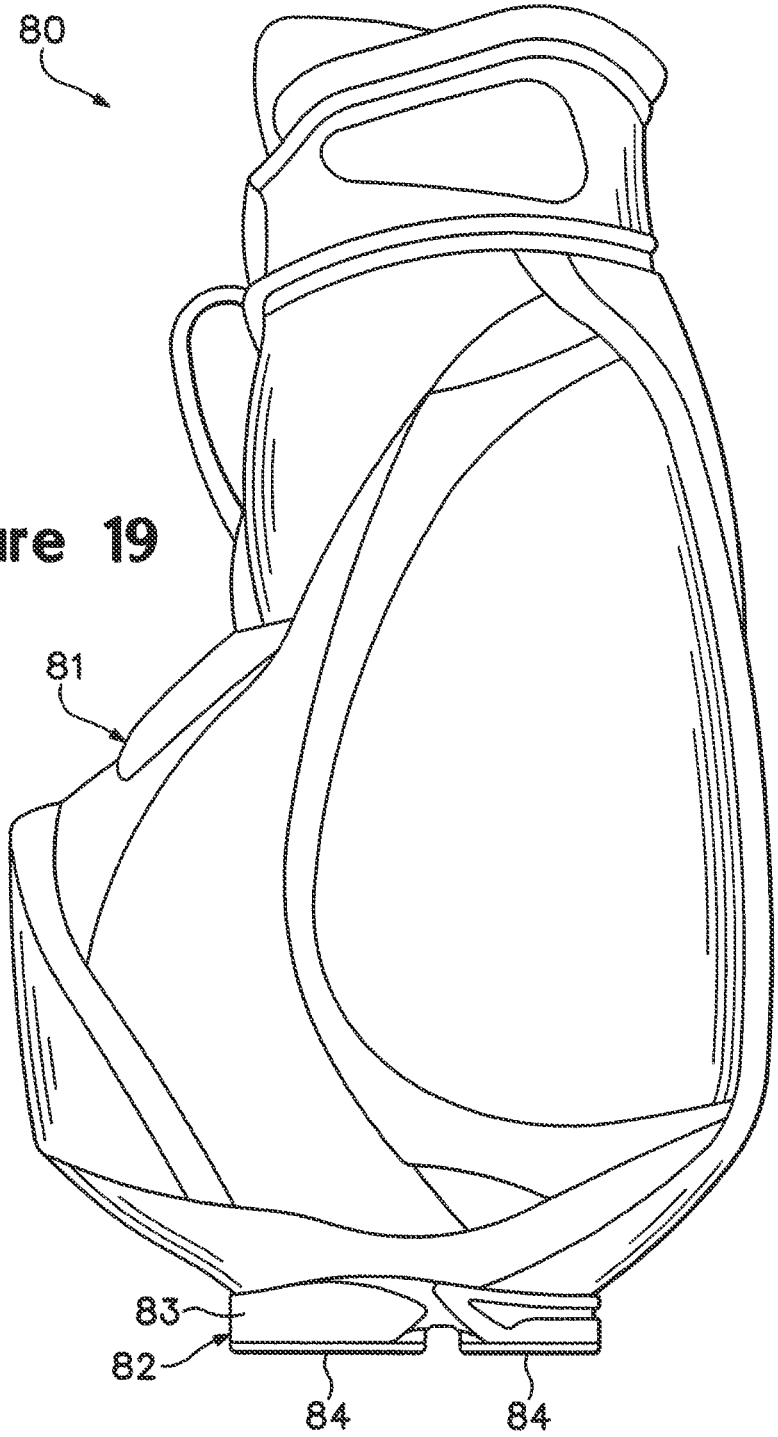
FIG. 19 is a side elevational view of another golf bag in accordance with aspects of the present invention.

A base having the general configuration of base 309 and base 309' may also be applied to other types of golf bags that do not include a support assembly. Referring to FIG. 19, a cart-style golf bag 80 is depicted. Golf bag 80 includes a body 81 and a base 82. The primary element of base 82 are a contact element 83, and base 82 may include a plurality of wear elements 84 that are secured to contact element 83. As with the prior embodiments, contact element 83 may be formed from a polymer foam, such as ethylvinylacetate or polyurethane foam, and wear elements 84 may be formed from carbon black rubber compound, for example. Accordingly, the general concept of utilizing a polymer foam with wear elements to form a golf bag base may be applied to a plurality of golf bag types. Of course, even this large golf bag type construction may be fit with dual carrying strap assemblies of the type described above without departing from the invention.

Numerous modifications may be made to the configuration of base 309 and base 309' that are disclosed above. For example, sidewall 311 may include an indentation that circumscribes the upper surface of sidewall 311 and receives the material elements of housing 301. Accordingly, the material elements may extend between the interior and exterior surface of sidewall 311. Frame 308 is disclosed as a single shaft that extends along a side of housing 301, but may have the configuration of multiple stay rods that extend between divider 312 and base 309. A plurality of stay sockets that receive the stay rods may, therefore, be molded into base 309. In some embodiments, an internal frame may extend around base 309 to provide additional stability. Furthermore, additional connecting elements may be added to base 309 to connect partitions that separate golf club shafts. If desired, all of the example bags may include dual carrying strap assemblies of the type described above without departing from the invention. Accordingly, the invention is not confined to the specifically illustrated examples. Rather, the spirit and scope of the invention should be construed broadly as set forth in the appended claims.

We claim:

1. A shoulder strap assembly, comprising:
- a first shoulder strap including:
  - a common area,
  - a first strap element extending from the common area and having a first end,
  - a second strap element extending from the common area and having a second end, and
  - a third strap element extending from the common area and having a third end;
- a receptor component engaged with the first shoulder strap at the common area; and
- a second shoulder strap having a first end movably coupled with the receptor component and having a second end; and
- wherein the first strap element, the second strap element, and the third strap element are non-releasably engaged with the common area.

2. The shoulder strap assembly of claim 1 wherein one of the first end, the second end, the third end, and the second end of the second shoulder strap include a coupling system for engaging with a carrying device.

3. A shoulder strap assembly according to claim 2, wherein the coupling system is adjustable.

4. The shoulder strap assembly of claim 1 wherein the first end is engaged with one of the second end, the third end, or the second end of the second shoulder strap.

5. The shoulder strap assembly of claim 1 wherein the second end of the second shoulder strap is engaged with one of the first end, the second end, or the third end.

6. A shoulder strap assembly according to claim 1, wherein the receptor component defines a slot into which the first end of the second shoulder strap is received, and wherein the receptor component constitutes the only receptor component connecting the first shoulder strap and the second shoulder strap at the common area.

7. A shoulder strap assembly according to claim 1, wherein the first shoulder strap is constructed from a foam material.

8. A shoulder strap assembly according to claim 1, wherein the first end of the second shoulder strap is pivotally coupled with the receptor component.

9. A shoulder strap assembly according to claim 1, wherein the first end of the second shoulder strap is pivotally movable and engaged such that it rotates freely with respect to the receptor component.

10. A shoulder strap assembly according to claim 1, wherein the first end of the second shoulder strap is pivotally movable and engaged such that it rotates freely with respect to the receptor component through 10 to 90 degrees of rotation.

11. A shoulder strap assembly according to claim 1, wherein the first end of the second shoulder strap is releasably engaged with the receptor component.

12. A shoulder strap assembly, comprising:
- a first shoulder strap including:
  - a common area,
  - a first strap element extending from and non-releasably engaged to the common area and having a first end having a first coupling system for engaging with a carrying device,
  - a second strap element extending from and non-releasably engaged to the common area and having a second end having a second coupling system for engaging with the carrying device, and
  - a third strap element extending from and non-releasably engaged to the common area and having a third end having a third coupling system for engaging with the carrying device;
- a receptor component engaged with the first shoulder strap at the common area; and
- a second shoulder strap having a first end movably coupled with the receptor component and having a second end having a fourth coupling system for engaging with the carrying device.

13. A shoulder strap assembly according to claim 12, wherein the first end of the second shoulder strap is pivotally movable and engaged such that it rotates freely with respect to the receptor component.

14. A shoulder strap assembly according to claim 13, wherein the first end of the second shoulder strap rotates freely with respect to the receptor component through 10 to 90 degrees of rotation.

15. A shoulder strap assembly, comprising:
- a first shoulder strap including:
  - a common area,
  - a first strap element extending from the common area and having a first end,
  - a second strap element extending from the common area and having a second end, and
  - a third strap element extending from the common area and having a third end;
- a receptor component engaged with the first shoulder strap at the common area; and
- a second shoulder strap having a first end movably coupled with the receptor component and having a second end; and
- wherein the first end of the second shoulder strap is pivotally movable and engaged such that it rotates freely with respect to the receptor component.

16. A shoulder strap assembly according to claim 15, wherein the first end of the second shoulder strap rotates freely with respect to the receptor component through 10 to 90 degrees of rotation.

17. The shoulder strap assembly of claim 15, wherein one of the first end, the second end, the third end, and the second end of the second shoulder strap include a coupling system for engaging with a carrying device.

18. The shoulder strap assembly of claim 15, wherein the first end is engaged with one of the second end, the third end, or the second end of the second shoulder strap.

19. A shoulder strap assembly according to claim 15, wherein the receptor component defines a slot into which the first end of the second shoulder strap is received, and wherein the receptor component constitutes the only receptor component connecting the first shoulder strap and the second shoulder strap at the common area.

20. A shoulder strap assembly according to claim 15, wherein the first end of the second shoulder strap is releasably engaged with the receptor component.

* * * * *